US005182579A

United States Patent [19]

Haruta et al.

[11] Patent Number: 5,182,579

[45] Date of Patent: Jan. 26, 1993

[54] INK-JET HAVING INK STORING ABSORBANT MATERIAL

[75] Inventors: Masahiro Haruta; Masami Ikeda, both of Tokyo; Seiichiro Karita, Yokohama; Nobuyuki Kuwabara, Tokyo; Takahisa Kawamura, Yokohama; Masahiko Higuma, Togane; Teruo Arashima, Kawasaki; Tsutomu Abe, Isehara; Osamu Nishiwaki, Atsugi; Shinichi Tochihara, Hadano; Akira Nagashima, Tokyo; Makoto Aoki, Yokohama; Kumiko Mafune, Kawasaki, all of Japan

[73] Assignee: Canon Kabushiki Kaisha, Tokyo, Japan

[21] Appl. No.: 727,910

[22] Filed: Jul. 10, 1991

[30] Foreign Application Priority Data

| | | | |
|---|---|---|---|
| Jul. 10, 1990 | [JP] | Japan | 2-180431 |
| Jul. 10, 1990 | [JP] | Japan | 2-180435 |
| Jul. 10, 1990 | [JP] | Japan | 2-180436 |
| Mar. 27, 1991 | [JP] | Japan | 3-63205 |
| May 31, 1991 | [JP] | Japan | 3-155920 |
| Jun. 29, 1991 | [JP] | Japan | 3-159225 |

[51] Int. Cl.[5] ..... B41J 2/175; B41J 2/05

[52] U.S. Cl. ..... 346/140 R

[58] Field of Search ..... 346/140 R

[56] References Cited

U.S. PATENT DOCUMENTS

| | | | |
|---|---|---|---|
| 4,306,245 | 12/1981 | Kasugayama et al. | 346/140 |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,771,295 | 9/1988 | Baker | 346/1.1 |
| 4,790,409 | 12/1988 | Deaver | 181/265 |
| 4,824,887 | 4/1989 | Aycock et al. | 524/151 |
| 4,929,969 | 5/1990 | Morris | 346/140 R |

FOREIGN PATENT DOCUMENTS

| | | |
|---|---|---|
| 0073474 | 3/1983 | European Pat. Off. . |
| 0261764 | 3/1988 | European Pat. Off. . |
| 0359376 | 3/1990 | European Pat. Off. . |
| 55-42874 | 3/1980 | Japan . |
| 59-123670 | 7/1984 | Japan . |
| 59-138461 | 8/1984 | Japan . |
| 64-522 | 1/1989 | Japan . |
| 0126452 | 1/1989 | Japan . |
| 0126453 | 1/1989 | Japan . |

OTHER PUBLICATIONS

Baker et al., Design and Development of a Color Thermal Inkjet Print cartridge; H-P Journal, Aug. 1988, pp. 6–15.

*Primary Examiner*—Joseph W. Hartary

*Attorney, Agent, or Firm*—Fitzpatrick, Cella, Harper & Scinto

[57] ABSTRACT

An ink tank having an ink storing portion encases an ink-absorbent member for holding ink. The ink-absorbent member comprises a porous material having therein compressed open cells. The compression ratio $r_1$ of an apparent volume $V_1$ before compression to an apparent volume $V_2$ after compression ($r_1 = V_1/V_2$) and the cell number p represented by number of cells per inch in the state of $V_1$ satisfy the relation (I) below, and p being not more than 60.

$$100\ [\text{inch}^{-1}] \leqq r_1 \cdot p \leqq 200\ [\text{inch}^{-1}] \quad \text{(I)}$$

88 Claims, 17 Drawing Sheets

INK-JET HAVING INK STORING ABSORBANT MATERIAL

BACKGROUND OF THE INVENTION

Field of the Invention

The present invention relates to an ink tank encasing an ink absorbent member for storing an ink to be supplied to an energy-generating means, an ink-jet cartridge having the ink tank, and an ink-jet recording apparatus having the ink-jet cartridge.

Related Background Art

Ink-jet heads (or ink-jet cartridges) that have already been commercialized are constituted of an energy-generating portion for generating energy for forming recording liquid droplets and an ink tank for supplying ink thereto in one body. Generally, in such types of ink heads, ink is held absorbed by a porous material compressed and encased in an ink tank. The ink held by the porous material is driven out by capillary force of a nozzle in accordance with ink consumption at the ink ejection portion through a common liquid chamber communicating from a supply opening to an ink ejection portion.

As an ink storing material employed in such ink-jet cartridges, there have been known typical polyurethane foams (ink absorbing material). U.S. Pat. No. 4,306,245 (Japanese Patent Application Laid-Open No. Sho-55-42874) discloses a specific use range of the ink absorbing material for an ink-jet recording apparatus. However, the patent publication does not discuss the difficulties in practical uses. Further, U.S. Pat. No. 4,790,409 (Japanese Patent Application Laid-Open No. Hei-1-522), Japanese Patent Application Laid-Open No. Hei-1-26452, and U.S. Pat. No. 4,824,887 (Japanese Patent Application Laid-Open No. Hei-1-26453) disclose merely fabrication of a commercial foam into a size suitable for a foam-encasing portion, and washing of non-volatile matter which may cause clogging of the ink ejection outlet.

The structure and the production conditions required for the ink-absorbing material are not investigated thoroughly for the purpose of sufficient supply of ink from the ink-impregnated porous material to the recording head, as described above. The adjustment of ink supply has been made by the shape of the porous material encased in an ink-storing portion (or ink tank) and the amount of ink contained therein. Accordingly, the suitable range for the shape of the porous material is narrow, and the production cost is high.

Polyurethane foams are generally used as the porous material for holding ink (hereinafter referred to as an "absorbent member", and also referred to as "absorbing body"). The polyurethane foam is produced by reacting a polyol with an isocyanate by employing a blowing aid, a catalyst, a foam stabilizer, a coloring matter, and other additives for the foam, and subsequently heating it. In the production, various properties of polyurethanes are produced depending on the starting materials and the heating method. Usually, the polyurethane is mass-produced economically, and the foam properties of the mass-produced polyurethane are not necessarily uniform. Therefore, for use as the absorbent member, the portion having necessary properties had to be selected from the polyurethane foams, which wastes a large portion of the polyurethane, and requires troublesome tests.

The necessary properties of the polyurethane mentioned herein includes capability of supplying ink satisfactorily to an ejection energy-generating means, and capability of holding ink therein uniformly without undesired leaking out. In order to secure such properties, the absorbent member had to have suitable ink holding capacity, and a uniform cell size. For obtaining these properties, selection has to be conducted from many mass-produced absorbent members. If the selection is not properly made, various problems arises such that ejection of a recording liquid becomes unstable; the recording begins to fail, requiring exchange of the ink absorbent member even though much ink still remains in the ink tank; the ink leaks out from the absorbent member and further from the ink tank; and so forth.

Further, an ink-jet cartridge having a recording head in integration involves the problems of leakage of liquid ink on movement of an ink cartridge on a carriage; adverse effect on recording ejection performance caused by gravity acceleration on return movement of the carriage; and irregularity of recording quality caused by vibration on transportation or handling of the recording head.

SUMMARY OF THE INVENTION

The object of the present invention is to provide a guideline for design of an absorbent member which enables broadening the applicable range of the absorbent member and attains satisfactory performance at low cost.

According to an aspect of the present invention, there is provided an ink tank having an ink storing portion encasing an ink-absorbent member for holding ink, the ink-absorbent member comprising a porous material having therein compressed open cells, the compression ratio $r_1$ of an apparent volume $V_1$ before compression to an apparent volume $V_2$ after compression ($r_1=V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \qquad \text{(I)}$$

According to another aspect of the present invention, there is provided an ink-jet cartridge having an ink storing portion encasing an ink absorbent member for holding ink, the ink-absorbent member comprising a porous material having therein open cells, the volume ratio k of an apparent volume $V_5$ of the porous material in a dried and no-ink-containing state outside the ink storing portion to an apparent volume $V_6$ of the porous material in an ink-impregnated state encased in the ink storing portion ($k=V_5/V_6$) and the cell number p represented by number of cells per inch in the state of $V_1$ satisfying the relation (I) below, and p being not more than 60:

$$100\ [\text{inch}^{-1}] \leqq k \cdot p \leqq 200\ [\text{inch}^{-1}] \qquad \text{(III)}$$

According to still another aspect of the present invention, there is provided an ink-jet cartridge having an ejection energy-generating means for ejecting ink and an ink storing portion encasing an ink-absorbent member for holding ink to be supplied to the ejection energy-generating means, the ink-absorbent member comprising a porous material having therein compressed open cells, the compression ratio $r_1$ of an apparent volume $V_1$ before compression to an apparent volume $V_2$ after compression ($r_1=V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

According to still another aspect of the present invention, there is provided an ink-jet cartridge having an ejection energy-generating means for ejecting ink and an ink storing portion encasing an ink-absorbent member for holding ink to be supplied to the ejection energy-generating means, the ink-absorbent member comprising a porous material having therein open cells, the volume ratio k of an apparent volume $V_5$ of the porous material in a dried and no-ink-containing state outside the ink storing portion to an apparent volume $V_6$ of the porous material in an ink-impregnated state encased in the ink storing portion ($k=V_5/V_6$) and the cell number p represented by number of cells per inch in the state of $V_1$ satisfying the relation (I) below, and p being not more than 60:

$$100\ [\text{inch}^{-1}] \leqq k \cdot p \leqq 200\ [\text{inch}^{-1}] \quad \text{(III)}$$

According to a further aspect of the present invention, there is provided an ink-jet cartridge provided with an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, a supply tube for supplying ink pressed into an ink-absorbent member in the ink-storing portion, and a filter at an end of the supply tube; the ink-absorbent member comprising a porous material having therein compressed open cells, the compression ratio $r_1$ of an apparent volume $V_1$ before compression to an apparent volume $V_2$ after compression ($r_1=V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

According to a still further aspect of the present invention, there is provided an ink-jet cartridge provided with an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, and a supply tube for supplying ink pressed into an ink-absorbent member in the ink-storing portion, and a filter at an end of the supply tube; the ink-absorbent member comprising a porous material having therein open cells, the volume ratio k of an apparent volume $V_5$ of the porous material in a dried and no-ink-containing state outside the ink storing portion to an apparent volume $V_6$ of the ink storing portion ($K=V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \quad \text{(III)}$$

According to a still further aspect of the present invention, there is provided an ink-jet recording apparatus provided with an ink cartridge having an ejection energy-generating means for ejecting ink and an ink storing portion encasing an ink-absorbent member for holding ink to be supplied to the ejection energy-generating means, a carriage for moving the ink-jet cartridge to a desired direction, and an electric signal supplying means for supplying an electric signal to the ejection energy-generating means; the ink-absorbent member comprising a porous material having therein compressed open cells, the compression ratio $r_1$ of an apparent volume $V_1$ before compression to an apparent volume $V_2$ after compression ($r_1=V_1/V_2$) and the cell number p represented by number of cell per inch in the state of $V_1$ satisfying the relation (I) below, and p being not more than 60:

$$100\ [\text{inch}^{-1} \leqq r_1 \cdot p \leqq 200\ [\text{inch}^{-1}] \quad \text{(II)}$$

According to a still further aspect of the present invention, there is provided an ink-jet recording apparatus provided with an ink cartridge having an ejection energy-generating means for ejecting ink and an ink storing portion encasing an ink-absorbent member for holding ink to be supplied to the ejection energy-generating means, a carriage for moving the ink-jet cartridge to a desired direction, and an electric signal supplying means for supplying an electric signal to the ejection energy-generating means; the ink-absorbent member comprising a porous material having therein open cells, the volume ratio k of an apparent volume $V_5$ of the porous material in a dried and no-ink-containing state outside the ink storing portion to an apparent volume $V_6$ of the porous material in an ink-impregnated state encased in the ink storing portion ($K=V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}-1] \quad \text{(III)}$$

According to a still further aspect of the present invention, there is provided an ink-jet recording apparatus provided with an ink cartridge having an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, a supply tube for supplying ink pressed into an ink-absorbent member in the ink-storing portion, and a filter at an end of the supply tube; the ink-absorbent member comprising a porous material having therein compressed open cells, the compression ratio $r_1$ of an apparent volume $V_1$ before compression to an apparent volume $V_2$ after compression ($r_1=V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

According to a still further aspect of the present invention, there is provided an ink-jet recording apparatus provided with an ink cartridge having an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, and a supply tube for supplying ink pressed into an ink-absorbent member in the ink-storing portion; the ink-absorbent member comprising a porous material, the volume ratio k of an apparent volume $V_5$ of the porous material in a dried and no-ink-containing state outside the ink storing portion to the volume $V_6$ of the ink storing portion ($K=V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \qquad \text{(III)}$$

DESCRIPTION OF THE PREFERRED EMBODIMENT

The embodiment of the present invention is described below by reference to the drawings.

Figure 1:
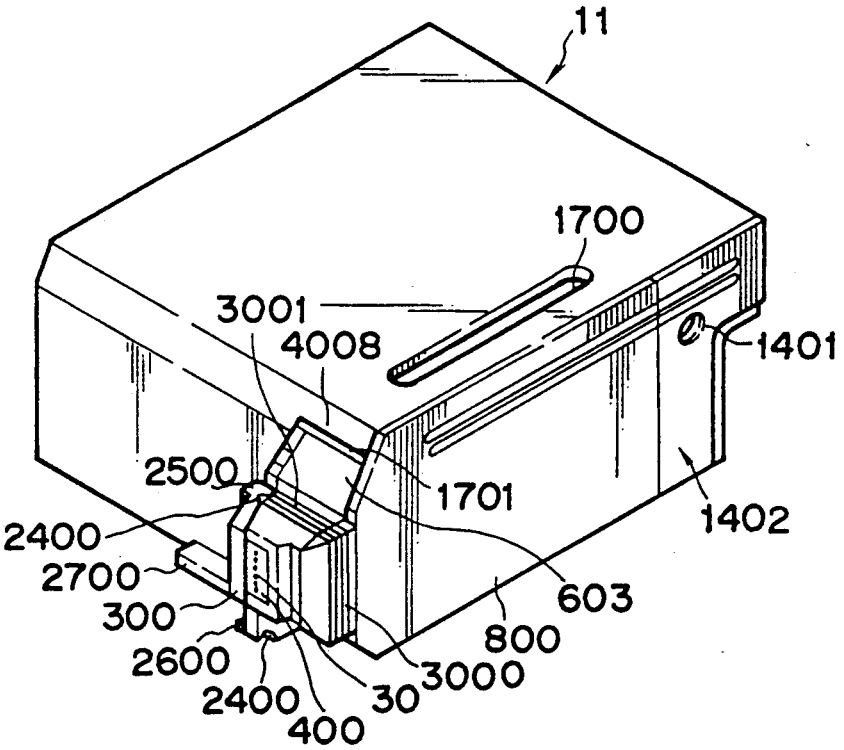
FIG. 1 is an oblique view of an ink-jet cartridge 11 employed in an ink-jet recording apparatus in an example of the present invention.
Figure 2:
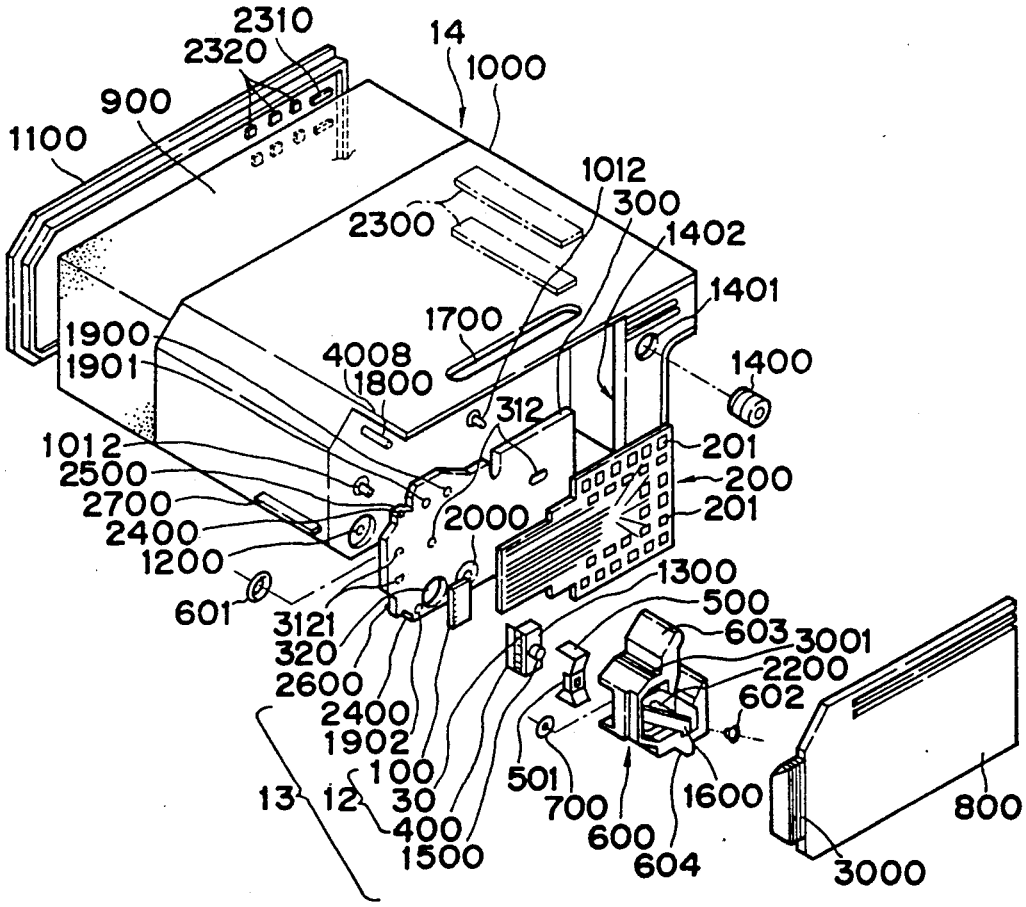
FIG. 2 is an exploded view showing the construction of the ink cartridge 11.

FIG. 1 is an oblique view of an ink-jet cartridge 11 employed in an ink-jet recording apparatus of the present invention. FIG. 2 is an exploded view showing the construction of the ink-jet cartridge 11. The following description is mainly based on FIG. 2, and other referred drawings are denoted by Fig. number in parentheses.

The ink-jet cartridge 11 is constructed from an ink-jet unit 13 including an ink-jet head 12 having a multiplicity of ejection outlets 30 formed in one body and including to a recording head, electric wiring thereto, and tubes, and an ink tank 14 for holding ink. The ink-jet cartridge 11 of this example has a larger ink-holding capacity than conventional ones, and has a tip portion of the ink unit 13 slightly projecting from the front face of the ink tank 14. This ink-jet cartridge 11 is fixed and supported by a registration means and electric contact points described later of carriage 16 mounted on main body 15 of the ink-jet recording apparatus, and is detachable from the carriage 16 (see FIG. 5).

Firstly, the construction of the ink-jet head 12 is explained.

Figure 3:
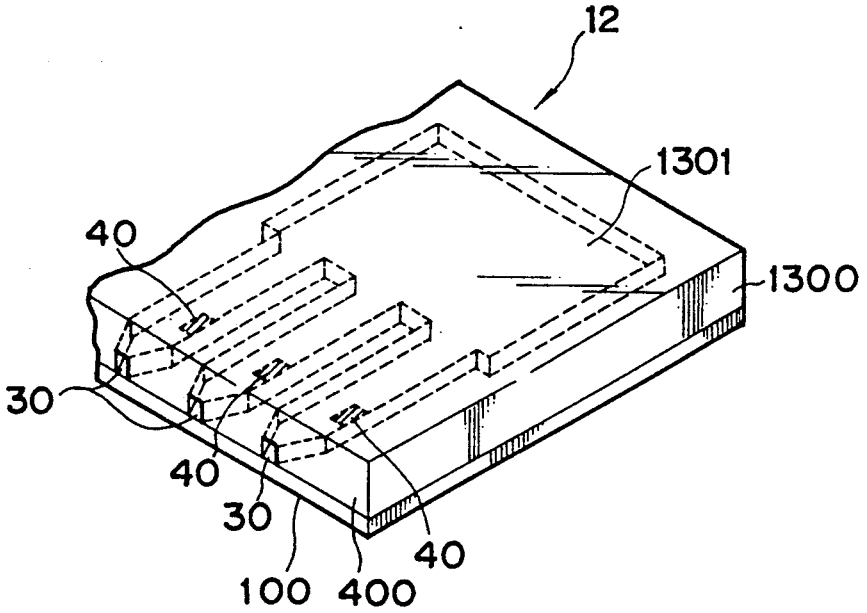
FIG. 3 is a partial oblique view of an ink-jet head 12.

As shown in FIG. 3, the ink-jet head 12 has a plurality of ejection outlets 30 placed in lines. And an electrothermal transducer 40 is provided in each liquid line for thermal energy generation by voltage application. Application of driving signals thereto causes generation of thermal energy in the electrothermal transducers, giving rise to film boiling to form bubbles in the ink liquid path. The growth of the bubbles serve to eject the ink droplets from the ejection outlets 30. The respective electro-thermal transducers 40 are provided on a heater board 100 composed to a silicon base plate, and are formed by film-forming technique integrally with aluminum wiring (not shown in the drawing) for supplying electric power to the respective electro-thermal transducer. The grooved cover plate 1300 having a separator for separating the plurality of ink paths and the common liquid chamber 1301 for holding ink temporarily, etc., an ink inlet 1500 for introducing ink from the ink tank 14 to a common liquid chamber 1301 and an orifice plate 400 having a plurality of ejection outlets 30 corresponding to respective ink flow paths are formed integrally. The material therefor is preferably polysulfone, but other molding resins such as polyethersulfone, polyphenylene oxide, polypropylene and the like may also be applicable.

Secondly, the construction of the ink-jet unit 13 is explained.

The one end of the wiring base board 200 is reciprocally connected to the wiring portion of the heater board 100 of the ink-jet head 12, and the other end of the wiring base board 200 is provided with a plurality of pads 201 corresponding to the respective electro-thermal transducer 40 (FIG. 3) for receiving electric signals from the main apparatus. Thereby the electric signals from the main apparatus is supplied to the respective electro-thermal transducers 40.

A metallic support 300 which supports the back side of the wiring base board 200 at a plane makes the bottom plate of the ink-jet unit 13. The pressor bar spring 500, which is in a M-letter shape, presses the common liquid chamber 1301 (FIG. 3) with the center portion of the M-shape. The apron portion 501 presses concentratedly a portion of the liquid paths, preferably the region around the ejection outlets 30 with a line pressure. The heater board 100 and the cover plate 1300 are engaged between the pressor bar spring 500 and the support 300 with the foot portion of the pressor bar spring engaged with the back side of the support 300 through the holes 3121, and press-fixed with each other by the concentrated force of the pressor bar spring 500 and the apron portion 501 thereof. The support 300 has holes 312, 1900, 2000 respectively engaged with the two registering projections 1012 of the ink tank 14, and registering and heat-fusion-holding projections, 1800 and 1801, and further has registering projections 2500 and 2600 at the back side corresponding to the carriage 16. The support 300 further has a hole 320 enabling an ink-supplying tube 2200 (described later) from the ink tank 14 to pass through. Onto the support 300, a wiring base plate 200 is bonded by use of an adhesive and so forth.

Figure 5:
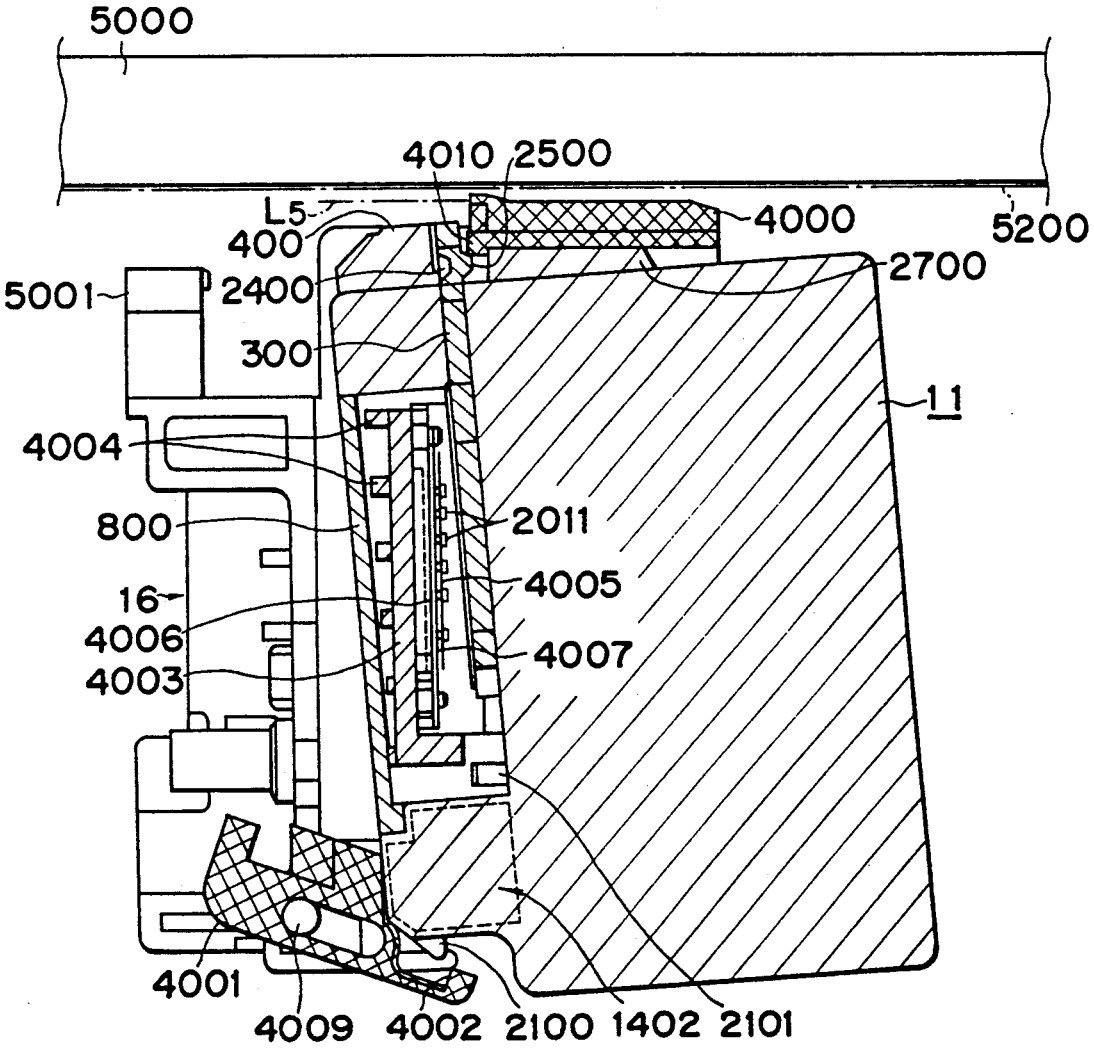
FIG. 5 is a drawing for explaining the fitting up of an ink-jet cartridge 11 to a main body 15 of an ink-jet recording apparatus 15.

The hollow portions 2400, 2400 of the support 300 are respectively made in the vicinity of the projections 2500, 2600, therefore, in the assembled ink-jet cartridge 11 (FIG. 1), they are at the tip region of the head which is formed by parallel grooves 3000, 3001, in surrounding three sides, thereby preventing the undesired matter such as dust and ink from reaching the projections 2500, 2600. The cover member 800 having parallel grooves 3000 forms the external wall of the ink cartridge 11, as shown in FIG. 5, and also forms a space with the ink tank 14 for holding the ink-jet unit 13. In the ink-supplying member 600 having a parallel grooves 3001 formed thereon, the ink introducing tube 1600 connected to the ink supplying tube 2200 is fixed in a form of a cantilever at the side of ink supplying tube 2200. In order to secure a capillary phenomenon between the fixed side of the ink-introducing tube 1600 and the ink supplying tube 2200, a sealing pin is inserted therein. A packing 601 is employed for connection of the ink tank 14 and the ink supplying tube 2200. A filter 700 is provided at the end portion of the ink supplying tube at the side of the ink tank 14.

Since the ink-supplying means 600 is prepared by mold-forming, it is inexpensive and is positionally precise, and the production accuracy is maintained high. Owing to the cantilever structure of the ink introducing tube 1600, the pressure-contact of the ink-introducing tube with the ink inlet 1500 is kept stably even in mass production. In this example, the communication state is ensured by flowing a sealing adhesive from the side of the ink-supplying member 600 under the pressure contact state. The ink-supplying member 600 is readily fixed to the support 300 in such a manner that two pins (not shown in the drawing) at the back side of the ink-supplying member 600 are projected through the holes 1901, 1902 on the support 300 respectively and fusion-bonded. The small projections formed by fusion bonding are accommodated by hollows (not shown in the drawing) on the lateral side of the ink tank 14 on which the ink-jet unit 13 is attached, so that the position of the ink-jet unit 13 is precise.

The construction of the ink tank 14 is described below.

The ink tank 14 is constituted by the main body of the cartridge 1000, the ink absorbent member 900, and the cover member 1100, and is formed by inserting the ink absorbent member 900 into the main body of the cartridge 1000 from the side opposite to the ink-jet unit 13, and subsequently sealing it with the cover member 1100.

The ink-absorbent member 900 is provided for holding the ink by impregnation, and is placed in the main body of the cartridge 1000. The detail is described later. The ink supply inlet 1200 is provided to supply ink to the ink-jet unit 13, and also serves in assembling the ink-jet cartridge 11 as an ink supply inlet for impregnating ink into the ink-absorbent member 900. The ink tank 14 has an air hole 1401 for communicating air to the inside, and a liquid repelling material 1400 is placed inside the air hole 1401 to prevent leakage of the ink therefrom.

In this example, for supplying ink satisfactorily from the ink-absorbent member 900, a continuous air space is formed by the ribs 2300 in the main body of the cartridge 1000 and the partial ribs 2310 and 2320 of the cover member 1100 in the region from the air hole 1401 to the corner portion most distant from the ink supply inlet 1200. Therefore, ink is supplied relatively satisfactorily from the ink supply inlet 1200 to the ink absorbent member 900, which is important. This method is extremely effective practically. The ribs 2300 four in number are provided on the back face of the main body of the cartridge 1000 of the ink tank 14 in a direction parallel to the moving direction of the carriage 16 (FIG. 6) to prevent the close contact of the ink-absorbent member 900 with the back face. The partial ribs 2310, 2320 are placed at the positions on extension lines of the ribs 2300 respectively and on the inside face of the cover member 1100, and are in a divided state different from that of the ribs 2300, so that the air space is enlarged. The partial ribs 2310, 2320 are distributed in the area not more than half of the all area of the cover member 1100. The ribs make the ink in the farthest corner portion from the ink supply outlet 1200 of the ink absorbent member 900 possible to introduce the ink by capillary force to the ink supply outlet 1200 from the farthest corner portion.

The aforementioned constitution and the arrangement of the ribs are particularly effective for the above ink tank 14, which has an ink holding space in a form of a rectangular solid having its long side on the side face. In the case where the rectangular solid has its long side along the direction of moving direction of the carriage 16 (FIG. 6), the ink supply from the ink-absorbent member can be stabilized by providing the ribs over the whole face of the cover member 1100. The rectangular solid form is suitable for holding ink as much as possible in a limited size of space. In order to use the stored ink effectively for recording without loss, the ribs playing the above role are preferably provided on two face regions neighboring to the corner portion. Further, the inside ribs of the ink tank 14 in this example are distributed uniformly in the thickness direction of the ink-absorbent member 900 in a rectangular solid form. This constitution enables maximum utilization of ink substantially of the entire ink in the ink-absorbent member 900 by uniformizing the atmospheric pressure distribution. The distribution of the ribs is based on the technical idea below. When the position of the ink supply inlet 1200 is projected onto the upper face of the rectangle of the rectangular solid and a circle is drawn round the projected position as a center with a radius of the length of the long side of the rectangle, it is important to provide the ribs at the area outside the circle line in order to early give the atmospheric pressure state. In this case, the position of the air hole of the ink tank is not limited to that in this example provided that the air is introduced to the rib-distributed region.

In this example, the back side of the ink cartridge 11 opposite to the ink-jet head 12 is made planar to minimize the necessary space when incorporated in the apparatus and maximize the quantity of the ink held therein, whereby the apparatus can be miniaturized and the frequency of cartridge exchange is decreased desirably. Behind the space for integrating the ink-jet unit 13, a projection of the air hole 1401 is formed and the inside of the projected portion is made vacant to form an atmospheric pressure supplying space 1402 for entire thickness of the ink-absorbent member 900. Such constitution gives an excellent ink-jet cartridge which has not ever been met. This atmospheric pressure supplying space 1402 is far much larger than conventional ones, and the air hole 1401 is placed at a higher position. Therefore, if the ink comes off the ink-absorbent member 900, this atmospheric pressure supplying space 1402 is capable of retaining the ink temporarily, enabling steady recovery of the ink to the ink-absorbent member 900, thus providing an efficient and excellent cartridge.

Figure 4:
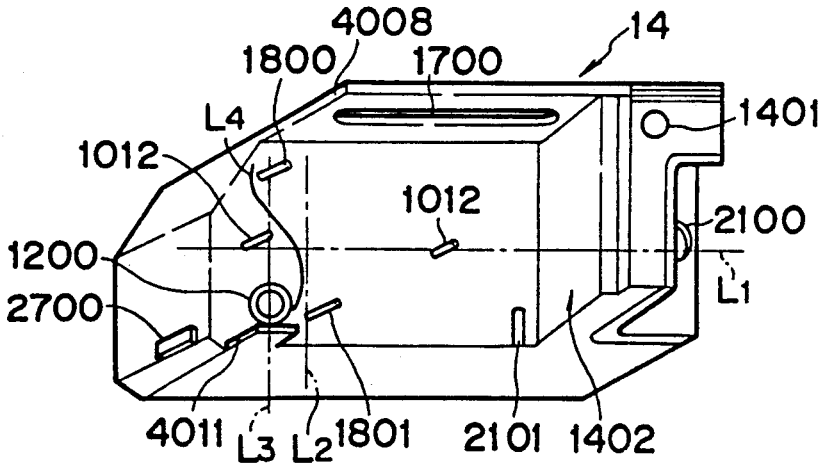
FIG. 4 is a drawing for explaining the portion of the ink tank 14 for fitting up the ink-jet unit 13.

The constitution of the face of the ink tank 14 on which the ink-jet unit 13 is attached is shown in FIG. 4. Two projections 1012 for registration engaging with the holes 312 on the support 300 is on a straight line $L_1$ which passes near the center of the ejection outlet of the orifice plate 400 and is parallel to the bottom face of the ink tank 14 or a base face of the mounting of the carriage 16. The height of the projection 1012 is slightly less than the thickness of the support 300, and register the support 300. On the extension line of $L_1$ in this drawing, a claw 2100 is provided which engages with an engaging face 4002 perpendicular to the hook 4001 for registering the carriage 16 is shown in FIG. 5. Thus the force for registering the carriage 16 exerts in the planar region parallel to the base face containing the line $L_1$. As mentioned later, such construction relation is effective since the accuracy of registration of the ink tank 14 itself is nearly equal to the accuracy of the positional registration of the outlet of the ink-jet head 12.

The projections 1800, 1801 of the ink tank 14 corresponding respectively to the holes 1900, 2000 on the support 300 for fixing it to the side face of the ink tank 14 are longer than the aforementioned projection 1012, and are utilized for fixing the support 300 by bonding by fusion of the portion projecting through the support 300. On a line $L_3$ perpendicular to the above-mentioned line $L_1$ and passing the projection 1800, approximate center of the ink supply inlet 1200 is placed. Thereby the bonding of the ink supply inlet 1200 with the ink supply tube 2200 is stabilized, and a load caused by dropping or impact exerted to the bonding portion is reduced. The line $L_2$ passes the projection 1801. The lines $L_2$, and $L_3$ do not coincide with each other. The projections 1800, 1801, also serve for registering the ink-jet head 12 relative to the ink tank 14. The curve $L_4$ denotes position of the outside wall when the ink supplying member 600 is mounted. The projections 1800, 1801 are along the curve $L_4$, which give sufficient strength and positional precision against the weight of the construction of tip portion of the ink-jet head 12. The tip collar 2700 of the ink-jet head 12 is inserted to the hole of the front plate 4000 (FIG. 5) of the carriage 16, to meet abnormality such as extreme displacement of the ink tank 14. The stopper 2101 against slipping from the carriage 16 is provided to fit a bar (not shown in the drawing) of the carriage 16, and is a protecting member for maintaining the mounted state when the ink-jet cartridge 11 comes under the bar at the position where cartridge 11 had been mounted and receives a vertical force to displace it from the determined position.

The ink-jet unit 13 is mounted to the ink tank 14, and then covered with the cover member 800 to enclose the ink-jet unit 13 except the bottom opening portion. The ink-jet cartridge 11, however, is mounted on the carriage 16, and the bottom opening comes close to the carriage 16, substantially forming a four-side-enclosed space. Although the enclosed space serves effectively for thermal insulation for heat generated by the ink-jet head 12, slight temperature rise will be caused in long time of running. As the counter-measure thereto in this example, a slit 1700 is provided which has a smaller width than the enclosed space to prevent temperature rise and simultaneously uniformize the temperature distribution throughout the the entire ink-jet unit 13 independently of the environment.

After the ink-jet cartridge 11 is assembled, the ink is supplied to the ink supplying member 600 from the interior of the main body of the cartridge 1000 through the ink supply inlet 1200, the hole 320 on the support 300, and an introducing opening at the back side of the ink supplying member 600, and then flows into the common liquid chamber through an outlet hole, a suitable supply tube, and the ink inlet 1500 on the cover plate 1300. The ink supply path is ensured by sealing the connections for jointing the ink with packings made of silicone rubber, butyl rubber or the like.

As described above, the ink supplying member 600, the cover plate 1300 with the orifice plate 400, and the main body of the cartridge 1000 are respectively molded as an integrated part, which makes the assemblage precise and is effective in high-quality mass production. The number of parts is less than conventional products, so that the intended superior characteristics are surely obtained.

In the assembled ink-jet cartridge 11 in this example, a slit 1701 is provided between the upper face 603 of the ink-supplying member 600 and the end portion 4008 of the roof portion having a long and narrow opening 1700 of the ink tank 14 as shown in FIG. 1. Similarly, a slit (not shown in the drawing) is formed between the bottom face 604 of the ink-supplying member 600 and a head-side end portion 4011 of the thin plate member adhered to the cover member 800 at the lower portion of the ink tank 14. These slits accelerate the heat release from the aforementioned opening 1700, and will prevent any direct action of force to the ink-supplying member 600 or the ink-jet unit 13 if unnecessary force is exerted to the ink tank 14.

As described above, the construction of the present invention is novel. Not only each of the construction units is effective singly, but also the combination thereof is particularly effective.

The mounting of the ink-jet cartridge 11 on the carriage 16 is explained below.

In FIG. 5, the platen roller 5000 guides the recording medium 5200 (e.g., recording paper) from the back side of the figure paper as shown in the figure to the front side of the figure paper. The carriage 16, which moves along the length direction of the platen roller 5000, is provided with a front plate 4000 (2 mm thick) in the front side of the carriage 16, namely the platen roller side, a supporting plate 4003 for electric connection described later, and a registering hook 4001 for fixing the ink-jet cartridge 11 at a predetermined recording position. The front plate 4000 has two projected face 4010 for registration corresponding to the projection 2500, 2600 of the support 300 of the ink-jet cartridge 11, and receives a force perpendicular to the projected face 4010 after the ink-jet cartridge 11 is mounted. Therefore, a plurality of strengthening ribs (not shown in the drawing) are provided on the platen roller 5000 side of the front plate 4000. These ribs also form head-projecting projection portions which project slightly (about 0.1 mm) from the front face position $L_5$ of the mounted ink-jet cartridge 11 toward the platen roller 5000. The supporting plate 4003 has a plurality of strengthening ribs 4004 which are directed vertical to the paper face of the drawing. The projection length of these ribs decreases from the one at the platen roller 5000 side to the one at the hook 4001 side, whereby the ink-jet cartridge 11 is mounted obliquely as shown in the drawing. The supporting plate 4003 has a flexible sheet 4005 provided with pads 2001 corresponding to the pads 201 on the wiring base board 200 of the ink cartridge 11, and a rubber pad sheet 4007 with botches for giving elasticity for pressing the flexible sheet to each pads 2011 from the back side. For stabilizing the electric contact between the pads 201 and the pads 2011, the supporting plate 4003 has a registration face 4006 at the hook 4001 side which exerts a force to the ink-jet cartridge 11 in a direction reverse to the exertion direction of the above projected face 4010. Pad contact is made therebetween, and the deformation of the botches of the rubber sheet 4007 corresponding to the pads 2011 is defined definitely. When the ink-jet cartridge 11 is fixed at the recording position, the registration face 4006 is in contact with the surface of the wiring base board 200. Since the pads 201 are distributed symmetrically regarding the aforementioned line $L_1$, the rubber pad sheet 4007 having botches deformed uniformly, and the contact pressure between the pads 2011 and the pads 201 is stabilized. In this example, the distribution of the pads 201 is in two lines vertically and in two lines laterally.

The hook 4001 has a long slit for engaging with a fixing axis 4009. After counterclockwise rotational movement from the position shown in the drawing by utilizing the moving space, the ink-jet cartridge 11 is registered relative to the carriage 16 by movement to left along the length direction of the platen roller 5000. The movement of the hook 4001 may be made in any manner, but preferably made by a lever manipulation. In any way, in the rotational movement of the hook 4001, the ink cartridge 11 moves toward the platen roller 5000 side to the position where the registering projections 2500, 2600 can be in contact with the projected face 4010 of the front plate 4000. By the lefthand movement of the hook 4001, with hook face at 90° being kept in close contact with the 90° face of the claw 2100 of the ink-jet cartridge 11, the ink-jet cartridge 11 rotates horizontally around the contact region of the projection 2500 with the projection face 4010, finally causing the contact of pads 201 with pads 2011. When the hook 4001 is come to be held at the predetermined position, or a fixing position, the complete contact of the pads 201 with the pads 2011, facial contact of projections 2500, 2600 with the projected face 4010, and facial contact of the hook face 4002 with the 90° face of the claw are realized, thus finishing the mounting of the ink-jet cartridge 11 on the carriage 16.

An outline of the main body of the ink-jet recording apparatus is explained below.

Figure 6:
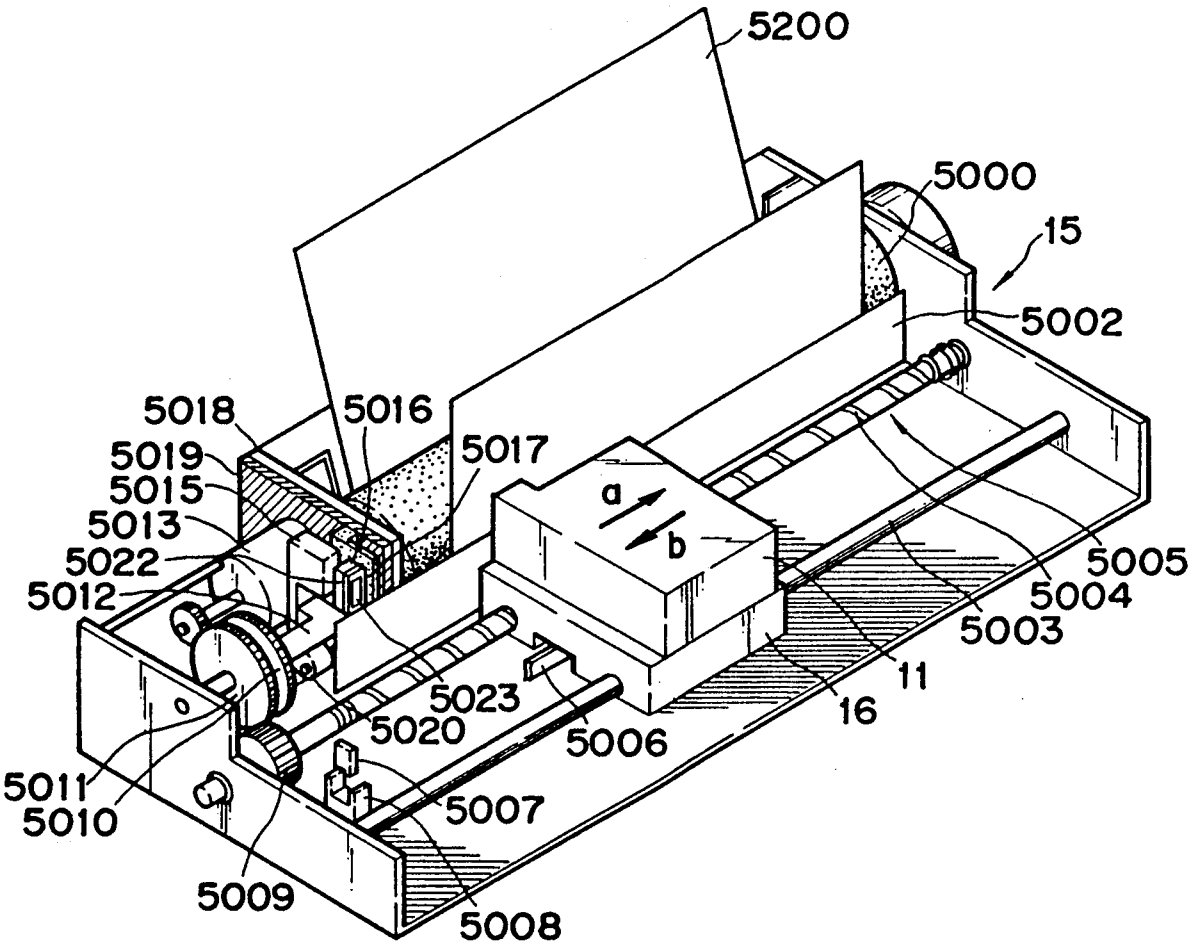
FIG. 6 is a schematic oblique view showing outline of an ink-jet recording apparatus 15.

An appearance of an ink-jet recording apparatus applicable in the present invention is shown in FIG. 6. A leading screw 5005 having a spiral groove 5004 is driven to rotate in normal or reversed direction by interlocking with a driving motor 5013 through driving force-transmitting gears 5011 and 5009. The carriage 16 is engaged with the spiral groove 5004 by a pin (not shown in the drawing) at the mounting portion 5001 (FIG. 5), and is guided slidably by a guiding rail 5003 to move in the direction shown by arrow marks a and b reciprocally. A paper-pressing plate pushes and presses a recording medium 5200 toward the platen roller 5000 throughout the moving direction of the carriage 16. Photocouplers 5007, 5008 constitutes a home-position-detecting means to confirm the position of the lever 5006 of the carriage 16 to be within the region and to control the driving direction, etc. of the driving motor 5013. A capping member 5022 for capping the front face of the ink-jet head 12 is supported by the supporting member 5016 and has a suction means 5015 for recovering suction of the ink-jet head 12 through an opening 5023 in the cap. The main-body-supporting plate 5018 has a supporting plate 5019. A cleaning blade 5017 supported slidably by the supporting plate 5019 is driven forward and backward by a driving means not shown in the drawing. The shape of the cleaning blade 5017 is not limited to the one shown in the drawing, but a variety of known shape of blades are applicable in the present example. The lever 5012 is provided to start the suction-recovery operation, moving with the movement of a cam 5020 engaging with the carriage 16. The movement is caused by the driving force of the driving motor 5013 transmitted by a known transmitting means such as a gear 5010, a shift clutch; and the like.

The respective operations of capping, cleaning, and suction recovery are conducted at the corresponding site by action of the leading screw 5005 when the carriage 16 comes to the home position. Any of the operations are applicable in the present invention, if the operations are conducted at a known timing and with a desired manner. The respective constructions are superior separately or combinedly, and are preferable in the present invention.

The ink-absorbent member used in the ink-jet cartridge of the present invention is explained below in detail.

The ink-absorbent member is a porous material having open cells therein and having ink-resistance, not deteriorated by the ink. The porous material is preferably a polyurethane foam. The polyurethane foam is produced, for example, by reacting a polyetherpolyol with a polyisocyanate and water (optionally employing a blowing agent, a catalyst, a coloring matter, and other additives) to synthesize a polymer compound having a number of voids, cutting into a desired size (or blocks), and immersing the block in an combustion gas atmosphere and exploding it to eliminate membranes between the cells.

The size of the cells of the porous material has to meet certain conditions to hold ink by capillary phenomenon and to supply ink to a head. However, the porous material obtained in the above production process has an exceedingly larger size of cells, which is not applicable as an ink-absorbent member, if the porous material is simply cut, as it is, into a size of the storage portion of the cartridge.

Accordingly, the working steps are needed in which the size of the cells is reduced as desired and the size of the foam is reduced to be housed in the storage portion of the cartridge. For these steps, compression of the porous material is conducted generally.

In the present invention, the porous material has only to satisfy the requirement shown below, and the method of the compression is not limited. The methods includes compression by a press machine before the porous material is encased in an ink tank; compression by a hot press before the porous material is encased in an ink tank; compression by pushing the non-compressed large porous material forcibly into an ink tank at the time when ink is incorporated therein; and a combination of the above compression methods. Any of these method will give the effect of the present invention.

Firstly, the ink-absorbent member of the present invention is obtained by compressing the porous material so as to meet the relation formula (1) below:

$$100 \text{ inch } [\text{inch}^{-1}] \leqq r_1 \cdot p \leqq 200 \ [\text{inch}^{-1}] \quad \text{(I)}$$

wherein $r_1$ is the compression ratio of an apparent volume $V_1$ before compression to an apparent volume $V_2$ after compression ($r_1 = V_1/V_2$) and the cell number p represented by number of cells per inch in the state of $V_1$, p being not more than 60.

The cell number p, which is represented by the number of cells per inch, is an average of the number of the cells per inch counted visually under microscope at 9 portions: namely, both end portions and a middle portions on planes dividing equally the porous material into three parts, and taking the average of the numbers. The volume $V_2$ is an apparent volume of the porous material after compression, and may be the apparent volume thereof outside an ink-storage portion in a dry state in which ink has been removed therefrom. The porous material thus derived is placed in an ink tank to make an ink cartridge.

In another way, the ink-absorbent member of the present invention is obtained by compressing the porous material so as to meet the relatin formula (2) below:

$$100 \ [\text{inch}^{-1}] \leqq r_2 \cdot p \leqq 200 \ [\text{inch}^{-1}] \quad (2)$$

wherein $r_2$ is the compression ratio of an apparent volume $V_3$ before hot pressing to an apparent volume $V_4$ after hot pressing ($r_2 = V_3/V_4$) and the cell number p represented by number of cells per inch in the state of $V_3$, p being not more than 60.

The value of "p", the cell number per inch, in the above relation formula is measured in the same manner as the method for p in the formula (1). The volume $V_4$ is an apparent volume of the porous material after hot pressing, and may be the apparent volume thereof outside an ink-storage portion in a dry state that ink has been removed therefrom. The porous material thus derived is placed in an ink tank to make an ink cartridge.

The hot pressing is preferably conducted by heading and holding the porous material at a temperature of from 180° C. to 200° C. for several tens of minutes by means of a hot pressing machine in consideration of the time for hot pressing, spring back of the porous material after hot pressing. However, the hot pressing temperature may be from 150° C. to 180° C. provided that the relation of the formula (2) is satisfied. The pressing may be of a six-direction type (or a six-sided type) provided that the relation of the formula (2) is satisfied. After the hot pressing, if necessary, the porous material is washed with an alcohol solution or the like which is replaced by pure water, and is dried in an oven at about 60° C. for 6 hours in an oven. Subsequently, the porous material is placed in an ink tank.

The porous material placed in a cartridge contains sufficient ink therein in the initial state of use. If the ink storage portion is directly linked with the ink-ejection portion without a buffer mechanism, gravitational acceleration produced on carriage return in the printer, as shown in FIG. 6, exerts inertia force to the ink in the cartridge in the direction of the acceleration, causing pressure variation in the ink, and influencing the pressure variation at the ink-ejection portion. In particular, if the hardness of the porous material is low, the porous material deforms with the movement of the ink, and may begin damping oscillation synchronously with the pressure variation in the cartridge. If the absorbent member itself for holding the ink vibrates, variation of the pressure applied to the ejection portion becomes larger to lower the quality of recording and to disturb continuous ejection. Generally, the gravitational acceleration produced in the carriage on carriage return in the printer is in the level of from about 0.5G to about 1.5G in the case of serial printers. Tests were conducted by use of porous materials produced by hot pressing and having various hardness. The results are shown in Table 1. The inner volume of the tank was about 40 cc. The amount of ink held in the tank was about 30 cc. The weight of the cartridge was about 57 g. The porous material used in the test was an ether type polyurethane prepared by the reaction of a polyetherpolyol with an isocyanate and water, and foam molding thereof. The polyurethane foam adjusted to have a desired hardness (measured according to JIS K 6401) was cut to a block of a desired size, and was inserted into the ink tank. In the urethane sponge foam, the walls between the cells were destroyed by a gas explosion method, whereby air permeability and interconnection of the cells are increased. The recording test was conducted by use of a test pattern which allows obvious recognition of low quality of recording and failure of ejection. In Table 1, the symbol ∘ denotes a combination of the conditions having no problems in recording; the symbol Δ denotes a combination of the conditions which causes defects of recording, such as chipping of dots, only in the initial stage of the carriage return; and the symbol x denotes a combination of conditions which causes frequent occurrence of defect of recording and failure of ejection invariably. From the results, it is understood that a hardness of not less than 2.0 kg.f is required for the urethane-made absorbent member.

Further, the absorbent members having hardnesses of 20 kg.f and 30 kg.f, and having respective apparent densities (densities of absorbent members when inserted into the tank) were tested for recordable number of sheets, and for ink leakage from the cartridge on free falling thereof from the height of 70 cm. The apparent densities were measured from the inside volume of the tank and the weight of the absorbent member which has been taken out from the tank, washed for ink removal, and dried.

The cartridges prepared under the preparation conditions as above was tested for continuous recording test. On paper sheets of A4 size, 1500 English letters were recorded continuously, and the recoverability was evaluated by the maximum number of the printed paper sheets which allowed continuous printing with ejection recovery treatment. In Table 2, the conditions under which not less than 500 sheets of recording was feasible are denoted by the symbol ○; and the conditions for not more than 500 sheets are denoted by the symbol x. In the ink leakage test, those causing no leakage are represented by the symbol ○; those causing oozing out of the ink are represented by the symbol Δ; and those causing complete leakage are represented by the symbol x. From these results, the absorbent member having an apparent density of not more than 0.20 g/cm$^3$ is superior in the two performances. Furthermore, a head holding an absorbent member having a hardness of less than 20 kg.f is found to cause frequently ink leakage on dropping, which is not shown in the Table.

As described above, an ink cartridge, which is free from defect of recording, enables complete utilization of ink, and caused no ink leakage can be provided by selecting the physical properties of the absorbent member.

In order to obtain the above characteristics the polyetherpolyol, which is one of the main starting material of the ether type urethane foam, has preferably a molecular weight of not less than 4000. By selecting such molecular weight, the above characteristics is readily achievable. Furthermore, to obtain the above characteristics, the cell number is in the range of from about 30 to about 50 per inch, and the compression ratio of about 3 (the volume is reduced to about one third).

Although ester type polyurethanes or other types of sponges may also be used, ether type urethane sponges are more preferable in consideration of ink resistance and storability.

In still another way, the ink-absorbent member of the present invention is obtained by compressing the porous material so as to meet the relation formula (3) below:

$$100\ [\text{inch}^{-1}] \leqq K \cdot p \leqq 200\ [\text{inch}^{-1}] \quad (3)$$

where $V_5$ is an apparent volume of the porous material out side the ink holding portion in a state that the ink is removed therefrom and is dried; V6 is an apparent volume of the porous material inserted in the ink holding portion and having ink impregnated therein; and k is a volume ratio and $K = V_5/V_6$.

p is a cell number represented by number of cells per inch, and is not more than 60. The value of p is measured as below. Firstly the porous material is taken out from the ink tank, the ink impregnated therein is removed, and the porous material is washed and dried. This washing is conducted by use of an aqueous solution which does not attack the porous material: for example, water or alcohol for an aqueous ink. The drying is conducted, for example, by placing the porous material in an oven kept at about 60° C. for about 6 hours. Subsequently, the number of the cells per inch is counted visually under microscope at 9 portions: namely both end portions and a middle portions, on each planes which divide the porous material into three equal parts perpendicular to at least one direction of pressing for compression insertion of the porous material into the ink tank, and averaging the observed numbers.

The value of $V_6$, which is an apparent volume of the porous material placed in the ink holding portion and having ink impregnated therein, is obtained in the manner as shown below. Three cartridges are used which have respectively the porous material therein. Of one cartridge, one face in the up-and-down direction is removed. Of another cartridge, one face in left-and-right direction is removed. Of the third cartridge, one face in front-and-back direction is removed. The selection of each of the directions of up-and-down, left-and-right, and front-and-back is arbitrary. By observing the removed face, the vertical, lateral, and height dimensions are measured in the inserted state in the cartridge. The volume $V_6$ is calculated therefrom.

Methods for compressing the porous material and inserting it into the ink tank are described below.

Figure 7:
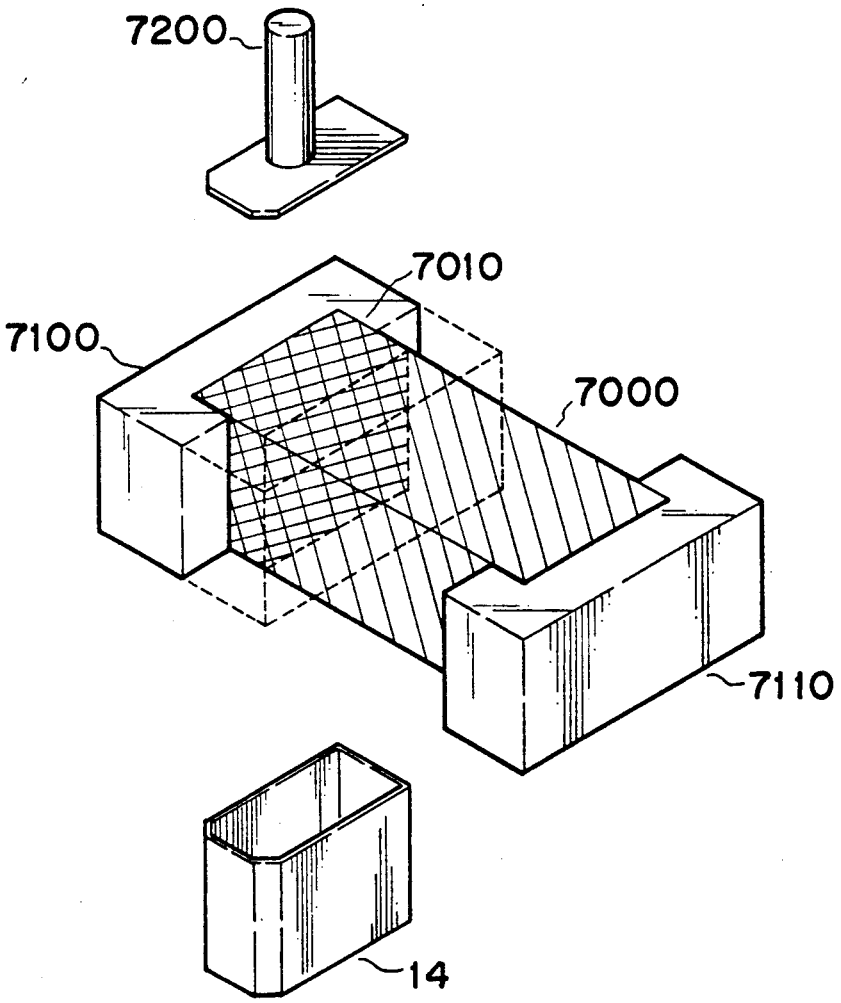
FIG. 7 is a schematic view of compression and insertion of a porous material.

An example of the methods for compression and insertion of a porous material is explained conceptionally by reference to FIG. 7.

A porous material 7000 is put between jigs 7100, 7110 having a U-shaped section, and is compressed by exerting force. After the porous material (shown by slightly slanted vertical lines in FIG. 7) is compressed to a desired size, the compressed porous material 7010 (shown by roughly lateral lines in FIG. 7) is inserted by a piston 7200 into an ink tank.

Figure 8:
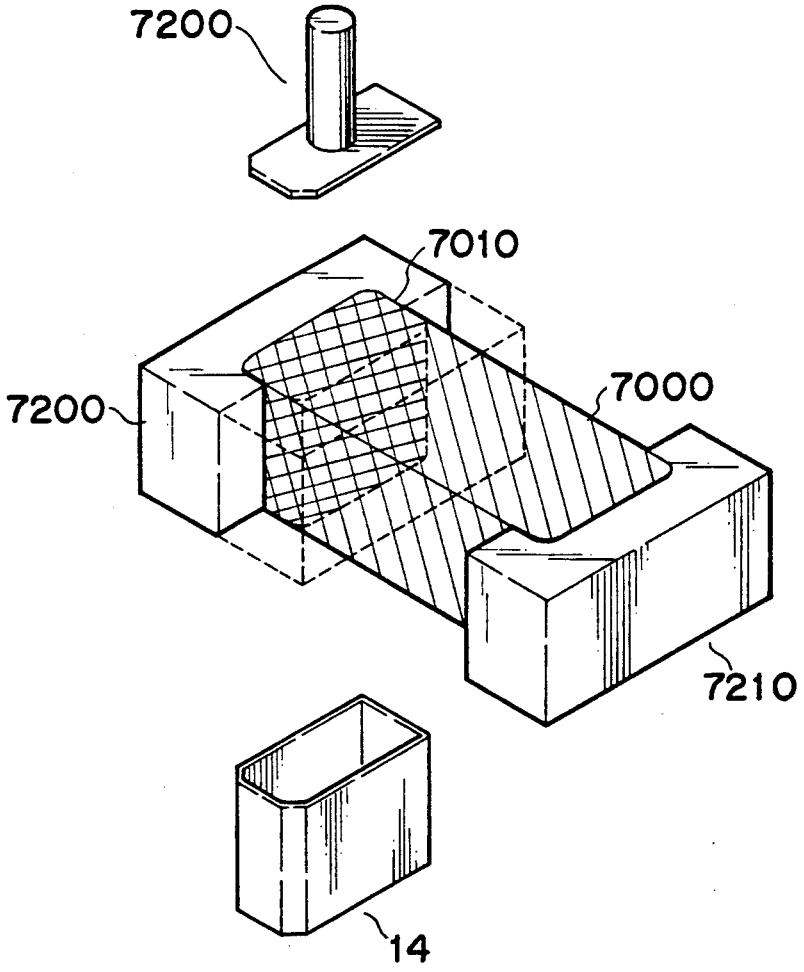
FIG. 8 is another schematic view of compression and insertion of a porous material.

Another example of the methods for compression and insertion of the porous material is shown in FIG. 8.

The jigs 7200, 7210 employed here have smooth curved inside face (at the portion brought into contact with the porous material 7000). The porous material 7000 is held between the jigs 7200, 7210, and is compressed by exerting force. The porous material 7000 can be deformed without bulging out from the jigs. After the porous material 7000 is compressed to the desired size, the compressed porous material 7010 is inserted into the ink tank.

In a still further method, the porous material, before it is compressed, is immersed in the ink or a liquid which does not react the ink, for example, pure water, subsequently the porous material is compressed to a desired size, cooled as it is to freeze the ink or the liquid which does not react the ink so that the porous material can keep the compressed size after the compression is removed, and then it is inserted into the ink tank. Otherwise, instead of freezing the liquid, the porous material is compressed to a desired size, and is cooled below the plastic deformation temperature of the porous material itself so that the porous material can keep the compressed size, and then it is inserted to the tank.

Figure 9:
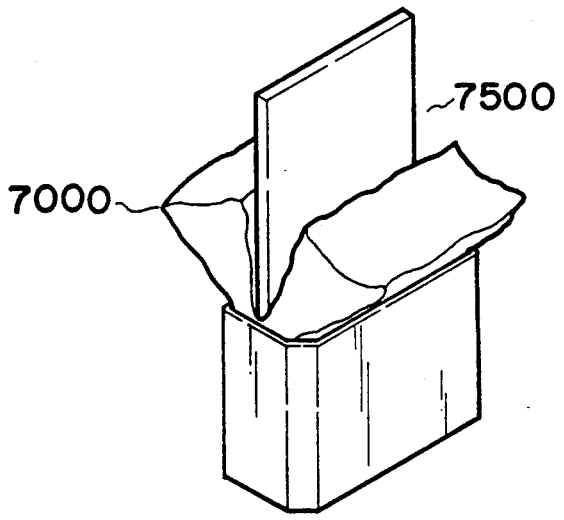
FIG. 9 shows folding insertion of a porous material.
Figure 10:
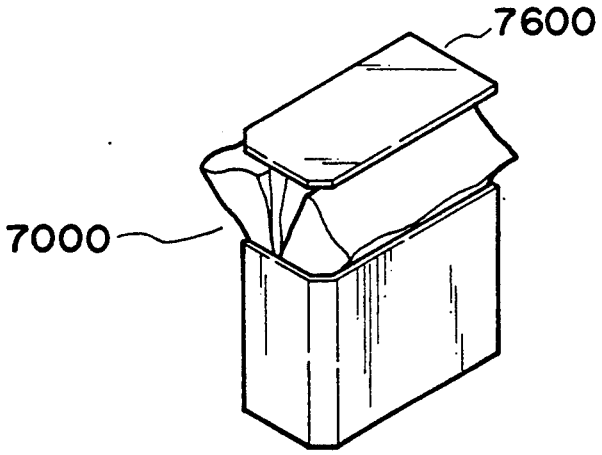
FIG. 10 is another drawing of folding insertion of a porous material.

In still another method, the porous material folded double is inserted to an ink tank. For example, as shown conceptionally in FIG. 9, the middle portion of the porous material is pushed with a jig 7500 to insert the porous material as it is folded double. In this method, the jig may be the cover 7600 of the ink tank.

With the ink tanks prepared by using the porous material (a polyether type polyurethane foam) pressed at various compression ratio t ($r_1$ or $r_2$) so as to satisfy the relation formula (1) or (2), the required properties for the ink absorbent member was evaluated. The results are shown in Table 3. Further, with the ink tanks prepared by compressing and inserting the porous material (a polyether type polyurethane foam) having various cell number p to give a volume ratio K, the required properties for the ink absorbent member were evaluated. The results are shown in Table 4. The properties were evaluated according to the methods (1) to (3).

(1) Continuous Recording Property

This property shows the effectiveness of continuous using up the ink in the ink tank. In recording by means of a printer provided with a cartridge (inside volume: about 40 cc, amount of injected ink: 30 cc), the capability of 500 sheets or more of recording is shown by the symbol ○; and the capability of recording of less than 500 sheets is shown by the symbol x.

(2) Recoverableness Characteristics

This property shows recovery from air incorporation caused by a suction pump, and possibility of recording at the time when the meniscus drops owing to increase of water head. The possibility of recording when half or more of the injected ink has been sucked out by continuous action of the suction pump on the cartridge is shown by the symbol ○; the possibility of suction by three times action of the suction pump when half or more of ink has been consumed by recording is shown by the symbol Δ; and impossibleness of the above two is shown by the symbol x.

(3) Mobility of Ink

This property shows leakage or non-leakage of ink from the cartridge by movement of ink caused by impact or vibration to exceed the holding power of the absorbent member, or recovery to the original state after localization of ink has once been caused. Regarding the absorbent members having relatively low level of values of $r_1 \cdot p$, $r_2 \cdot p$, or K·p, those resulting in ink leakage when the cartridge is dropped from the height of 70 cm are shown by the symbol x. Regarding the absorbent members having relatively high level of values of r1·p, r2·p, or K·p, those in which 70% or less of the ink restored to the original position after the cartridge having ink inside in a localized state was left standing for half a day are shown by the symbol x.

Table 3 and Table 4 show clearly that the porous materials having the value of $r_1 \cdot p$, $r_2 \cdot p$, or K·p in the range of from 100 $inch^{-1}$ to 200 $inch^{-1}$ are highly superior in the above properties required for an ink absorbent member for an ink-jet cartridge. In particular those having the value of $r_1 \cdot p$, $r_2 \cdot p$, or K·p in the range of from 120 $inch^{-1}$ to 150 $inch^{-1}$ are evaluated as "○" in all the properties of (1) to (3), and are highly preferable.

The ink-absorbent member of the present invention is superior because the compression ratio $r_1$ and $r_2$, and the volume ratio K serve to adjust the pseudo-sectional area of the cells in the porous material, and the cell number p serves to adjust cell size, circumference length, etc., and from the correlation thereof preferable retaining power (water head) of the ink-absorbent member is obtained.

Generally, a larger cell size and a lower compression ratio facilitate air passage and decreases undesirably ink-retaining power, if the surface tension of the ink is constant. Accordingly, air is liable to be incorporated and the air accumulates at a filter portion on continuous recording to inhibit the flow of ink, and further causes ink leakage because of mobility of ink on impact or falling.

To the contrary, a smaller cell size and greater compression ratio increase ink retaining power and increase the negative water head given to an ejection portion undesirably. Therefore, during recording, the negative pressure increases, the head response frequency becomes lower, the recording density becomes lower, recording defects arise, and the continuous recording comes to fail in a short period. Further, when inner negative pressure becomes highly rapid and exceeds the meniscus-retaining power, air is taken in from the ejection outlet, making the recovery completely infeasible. Further, the mobility of ink in the absorbing-body is made low, so that sudden start of recording after the head is left standing upside down is liable to cause recording defects because the ink is not readily movable.

An ink-absorbent member which does not tend to cause the aforementioned troubles is provided in the present invention by bringing the special values of $r_1 \cdot p$, $r_2 \cdot p$, or K·p as criteria within a certain range.

Furthermore, according to the method of the present invention, even when the number of the cells per inch in the porous material to be used deviates or varied greatly, the material can be used effectively and provides in simple steps the porous material having uniform characteristics in such a manner that the porous material is cut into a predetermined size of blocks or the like, the blocks or the like are classified into groups depending on the cell number, and each group of the blocks are hot-pressed under the conditions for satisfying the relation of formula (1).

Figure 11:
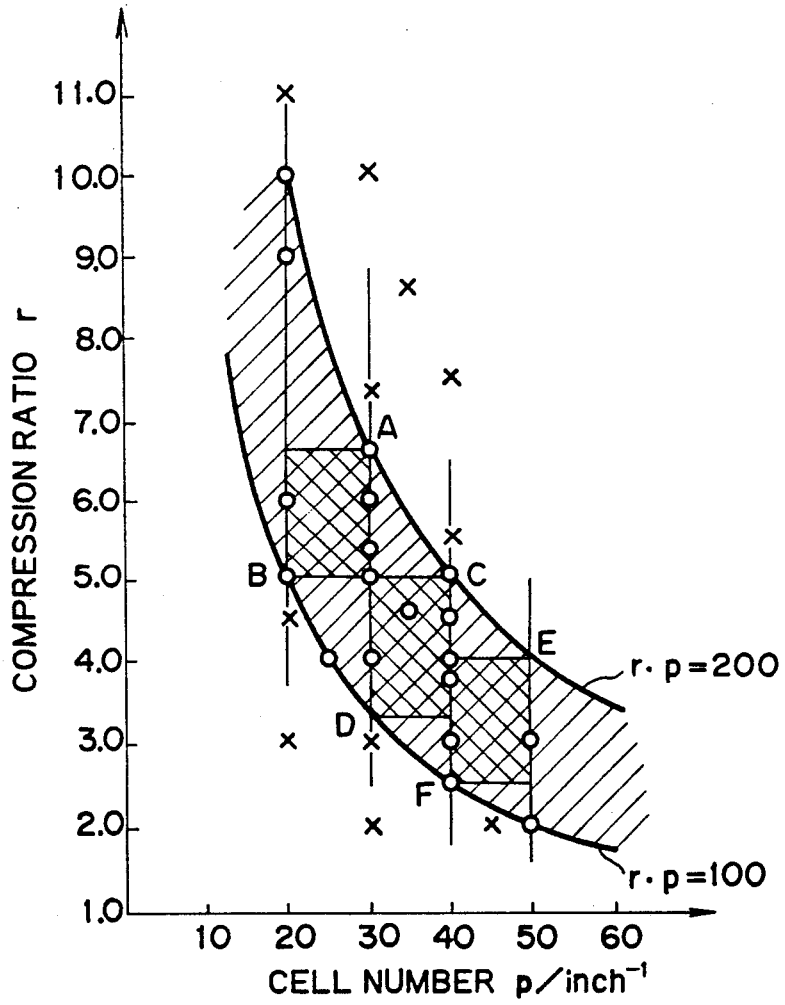
FIG. 11 is a graph showing the cell number p and the compression ratio r of the data of Table 3.
Figure 12:
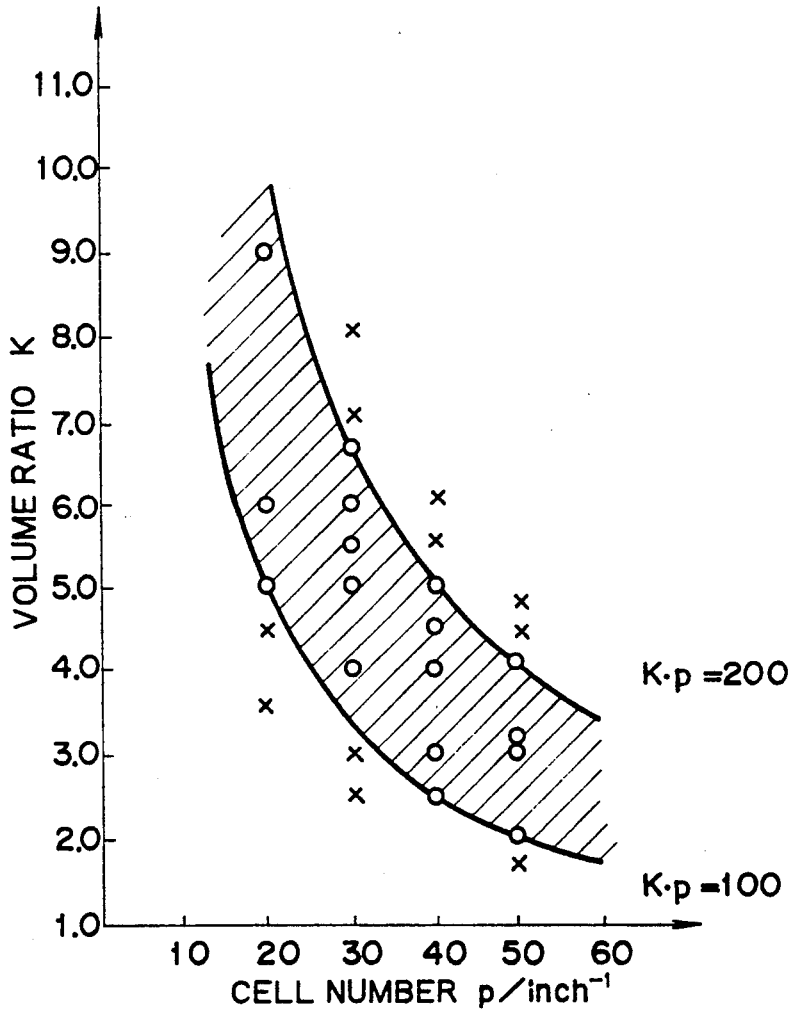
FIG. 12 is a graph showing the cell number and the volume ratio of the data of Table 4.

To explain such simple steps, the results shown in Table 3 and Table 4 are illustrated in FIG. 11 and FIG. 12, respectively. In these Figures, the samples which are evaluated as ○ or Δ in all the three characteristics of continuous recordability, recoverability, and ink mobility are shown by the symbol ○, and the others are shown by the symbol x. FIG. 11 shows that the critical effect is given within the range satisfying the relation of Formula (1) or Formula (2). FIG. 12 shows that the critical effect is given within the range satisfying the relation of Formula (3).

From FIG. 11 and FIG. 12, as the cell number solely, the value p is preferably in the range of from 20 $inch^{-1}$ to 60 $inch^{-1}$, more preferably from 30 $inch^{-1}$ to 50 $inch^{-1}$, still more preferably from 35 $inch^{-1}$ to 40 $inch^{-1}$. From the same figures, as the compression ratio solely, the compression ratio is preferably not higher than 10, more preferably not higher than 7, still more preferably not higher than 5. Practically the compression ratio is preferably in the range of from 2 to 5, more preferably from 3 to 4, still more preferably from 3.4 to 3.8. In consideration of the balance of the entire recording apparatus, variation of individual ink cartridges, and variation of individual recording apparatuses, any combination of the above cell number and the above compression ratio gives the effect of the present invention. The most desirable combination is the cell number of from 35 $inch^{-1}$ to 40 $inch^{-1}$ and the compression ratio of from 3.4 to 3.8.

The preparation of a porous material by hot pressing is explained specifically below.

A porous material within which the cell number distributes from 20 to 50 is cut into blocks. Among the blocks, the group of blocks having the cell number of 20–30 are hot-pressed at a compression ratio in the range of from the compression ratio $r_B$ at the point B ($p=20$, $r \cdot p=100$) to the compression ratio $r_A$ at the point A ($p=30$, $r \cdot p=200$) in FIG. 11; a group of blocks having the cell number of 30–40 are hot-pressed at a compression ratio in the range of from the compression ratio $r_D$ at the point D ($p=30$, $r \cdot p=100$) to the compression ratio $r_C$ at the point C ($p=40$, $r \cdot p=200$) in the same Fig.; and a group of blocks having the cell number of 40–50 are hot-pressed at a compression ratio in the range of from the compression ratio $r_F$ at the point F ($p=40$, $r \cdot p=100$) to the compression ratio $r_E$ at the point E ($p=50$, $r \cdot p=200$) in the same Fig. In such a manner, practically identical satisfactory absorbent members can be prepared even though the porous material varies in the cell number from 20 to 50.

The compression ratio $r_2$ can be changed by changing the parameter of the compression pressure, compressing temperature, the compression time, the thickness of the material in compressing direction, and so fourth. If the compressing temperature exceeds the decomposition temperature of the porous material (e.g., in the case of polyurethane, the temperature causing urethane linkage scission), a monomer formed by the decomposition is desirably washed off.

Figure 13:
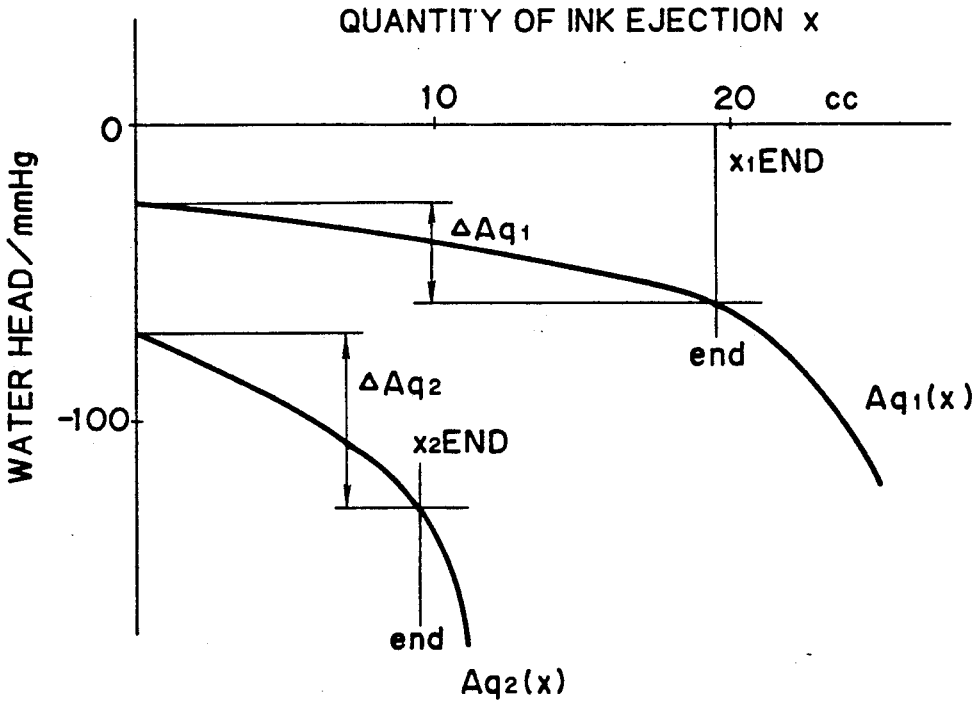
FIG. 13 is a graph showing dependence of the quantity of ink ejection on water head.

The dependence of the amount of ink discharge on the water head in the ink-absorbent member of the present invention is shown in FIG. 13. In this Fig., $Aq_1(x)$ denotes an absorption body of the present invention, and $Aq_2(x)$ denotes on absorbent member outside the present invention regarding the $r_1p$, $r_2p$ or kp value.

According to the present invention, as shown in the Fig., since the change of the water head during use of ink is exceedingly small ($\Delta q_1 < \Delta Aq_2$), satisfactory recording can be continuously obtained with less change of amount of ejection and less change of concentration. Even in solid black printing, the negative pressure of the absorbent member changes less, so that the recording can be conducted sufficiently continuously with uniform density ($\Delta Aq_1(x_1END) < Aq_2(x_2END)$).

Figure 14:
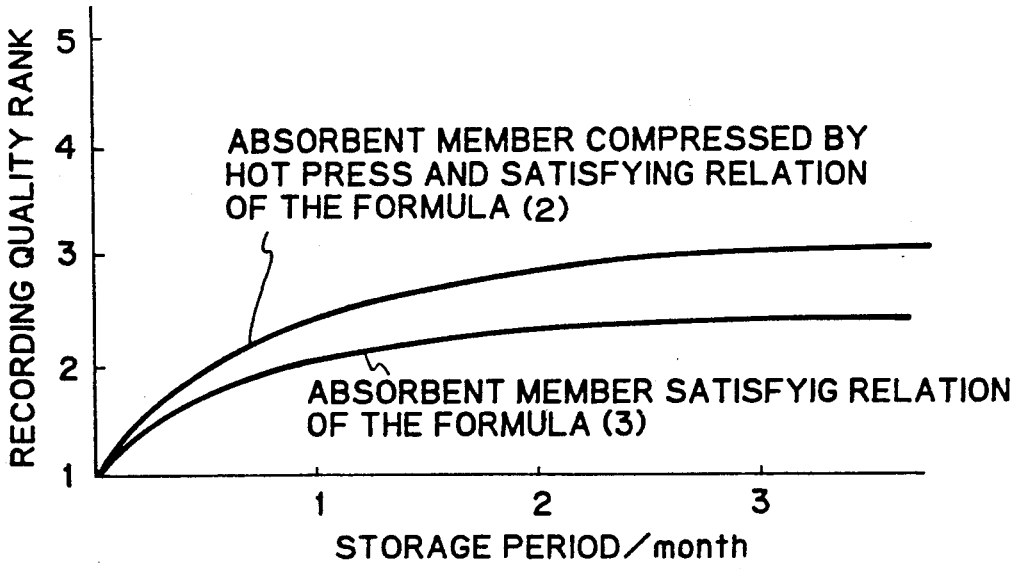
FIG. 14 shows the variation of the recording quality rank as a function of a storage period.

The ink cartridges having a hot-pressed absorbent member satisfying the relation of Formula (2) above and the ink-cartridges having an absorbent member satisfying the relation of Formula (3) were kept standing at a temperature of 60° C., and the dependence of the recording quality on the storage time length was investigated. FIG. 14 shows the results. In this experiment, the storage at 60° C. for one month is equivalent to storage at room temperature for about one year. The recording quality was evaluated overall in consideration of feathering of ink on the recording paper and decrease of optical density of image caused by ink penetration to the back side (penetration of ink to the back side of paper when a solid black image was recording on paper). The evaluation was made organoleptically. The grade "1" denotes the best recording quality; the grade "2" denotes a better recording quality; the grade "3" denotes a relatively good and acceptable recording quality; the grade "4" denotes a slightly inferior and unacceptable recording quality; and the grade "5" denotes a remarkably inferior recording quality. The evaluation was conducted by a plurality of persons, by taking the measure of the above five grades and averaging the resulting grades. The cartridge satisfying the relation of the above Formula (3) deteriorates less in the recording quality owing to suppression of impurity elution at a low level, in comparison with the ink cartridge having an absorbent member compressed by means of a hot press and satisfying the relation of the above Formula (2).

In the present invention, the porous material is compressed so as to satisfy the relation of Formula (1), (2), or (3). Although the method of compression is not limited, the direction of the compression should not be in the direction of ink supply on ink incorporation. This is necessary to obtain desired ink holding ability and to supply ink smoothly. Further, the direction of compression is most suitably perpendicular to the ink supply direction.

The above-mentioned invention of the ink-absorbent member is comprised of storing the ink-absorbent member in the inside of the ink storing portion after or while compressing the ink-absorbent member, whereby providing the superior contenious recording property, recovering property, and mobility of ink can be obtained, as explained above.

Next, the following is an explanation of conditions so as to make the present invention a more available one. The conditions enable the ink-absorbent member formed of the macromolecular material to improve the recording property itself as well as the above-mentioned properties in comparison with prior those, so that the following conditons are extremely available for the above invention. Enumerating the exemplary conditiones in the following: (i) a method of cleaning the absorbing body, (ii) a method of selecting the heating temperature at the heat compressing process, and (iii) a method of prescribing pH of ink to be impregnated into the absorbent member, and the optional combination thereof. In any of the conditions, attention was been paid to the eluted impurity into the ink which impurity is a material constituting the ink-absorbent member but quite different from dusts or impurities as the cause of clogging up. Therefore, such attention is novel.

Accordingly, the conditions are suitable those so as further to improve the property concerning the recording quality at the relation of the ink-absorbent member with the ink impregnated into the absorbent member.

Description will be made of a method of cleaning the ink-absorbent member mentioned in the above (i).

The ink absorbent member (which will be hereinafter referred to as "absorbent member") is usually made from a polyether-type polyurethane foam as a polymeric, elastic porous material having continued foam cells therein. The absorbent member can be prepared by conducting reaction of, for example, polyetherpolyol, dioctyl phthalate, toluene diisocyanate, etc. as starting materials in addition to an additive such as a silicon-based surfactant, etc. according to the conventional process, thereby foaming the reaction product and obtaining a foamed product having a desired porosity, then applying the foamed product to a known film-removal step based on a gas explosion, when required, then heat pressing the product to a desired compression ratio, and cutting the pressed product to a desired size. In the foregoing process for preparing an absorbent member, unreacted starting materials from the foaming step remain as impurities, and distribution of the impurities is made uneven in the pressing step. That is, a high possibility that the resulting absorbent member contains a considerable amount of unevenly distributed impurities necessitates a washing treatment of the absorbent member. The organic polar solvent incapable of reacting with the absorbent member is a polar solvent having a low volatility and no substantial influence on the absorbent member itself, and includes, for example, alcohols, ketones, ethers, nitrogen-containing solvents. Such solvents as those capable of dissolving or attaching urethane polymers as structural members of the skeleton of the absorbent members are not appropriate. The present solvent must dissolve well the impurities. In view of the above-mentioned conditions, some alcohols and ethers can be used preferentially. Particularly effective among them are, for example, monohydric alcohols having not more than 3 carbon atoms and alkyl ethers of polyhydric alcohols. The monohydric alcohols include, for example, methanol, ethanol, propanol, etc., and the alkyl ethers of polyhydric alcohols include, for example, methylcellosolve, ethylcellosolve, methylcarbitol, ethylcarbitol, triethyleneglycolmonomethylether, etc. These solvents, even if retained in a trace amount after the washing, do not seriously influence on the physical properties of ink.

These solvents can be used above or in combination of at least two thereof, or can be used as a solvent mixture with water. Particularly, the solvent mixture with water is more preferable from the viewpoint of safety. When the solvent mixture with water is used as a washing agent, a mixing ratio of water to the organic solvent by weight is approximately 9:1 to 1:9, preferably approximately 7:3 to 1:1, where a satisfactory washability can be maintained.

Eluted impurities existing in the absorbent member (where other substances than the urethane polymers constituting the skeletons of the absorbent member will be hereinafter referred to as "impurities" to designate soluble matters, that is, the matters soluble in an ink) can be effectively removed with the above-mentioned polar solvent, because it seems that the polar solvent can well permeate into the urethane polymer constituting the skeletons of the absorbent member to efficiently extract the unreacted monomers, etc. or to dissolve these impurities well therein.

Points found out concerning relations between the solvent and the impurities dissolved in the solvent will be described below together with the principle of the procedure for determining the impurities.

Figure 15:
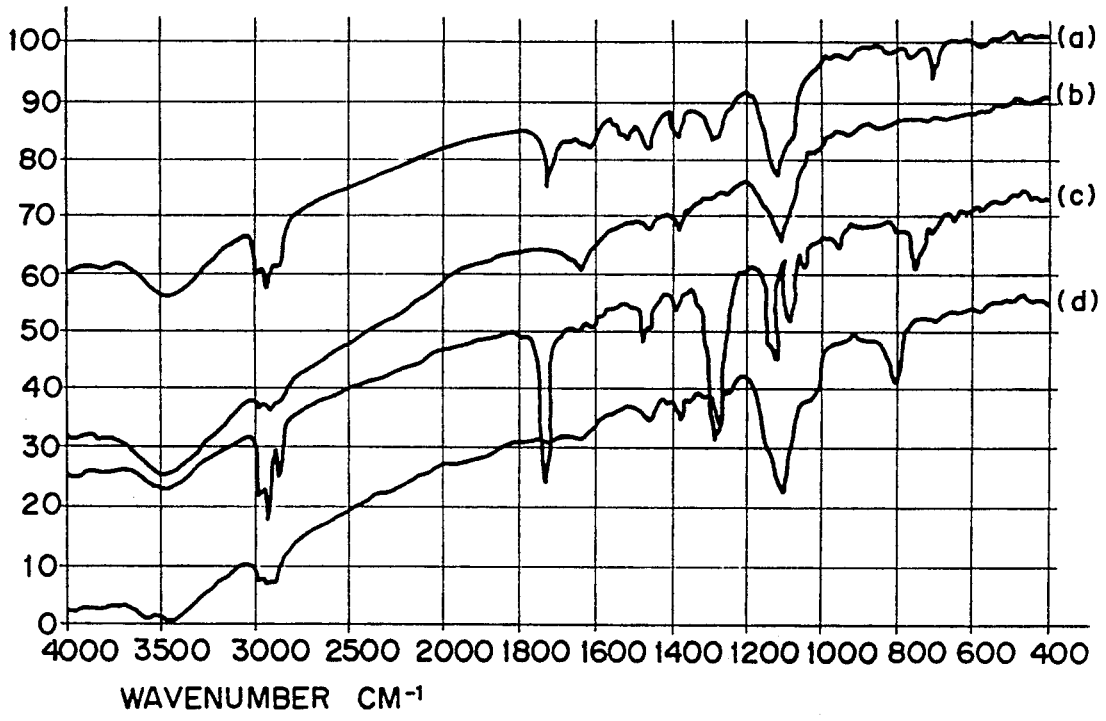
FIG. 15 is an IR spectrum of each of extracts.

FIG. 15 shows one example of results from component analysis of impurities by washing the absorbent member obtained according to the conventional process with ethanol, evaporating the ethanol washing solution to dryness and subjecting the sticky residues to infrared absorption (IR) spectroscopy (KBr tablet method), while conducting the same infrared absorption spectroscopy of polyetherpolyol, dioctyl phthalate and silicon-based surfactant as urethane foam raw materials and an additive, respectively, at the same time. IR spectroscopy is quite simple and can easily identify compounds through characteristic peaks. Comparative study of spectra of the resulting dissolved matters in the solvent reveals that the dissolved matters are mainly polyetherpolyol and dioctyl phthalate, where particularly polyetherpolyol is dominant. That is, it can be concluded from FIG. 15 that in the infrared spectrum (a) of dissolved matters from the absorbent member, the presence of dioctyl phthalate in (c) is shown by the presence of peak due to the carbonyl group at 1730 $cm^{-1}$, and the presence of polyetherpolyol in (b) and silicon-based surfactant in (d) is shown by the presence of peak due to the ether bond at 1110 $cm^{-1}$, but there is no peak in (a) at 800 $cm^{-1}$ as a characteristic absorption peak of silanol group, and thus the dissolved matters are mainly polyetherpolyol and dioctyl phthalate in the spectrum (a). Furthermore, comparison of peak depth at 1730 $cm^{-1}$ with that at 1110 $cm^{-1}$ in the spectrum (a) reveals the difference in the quantity, from which it is obvious that most of the impurities in the dissolved matters from the absorbent member is polyetherpolyol.

The above-mentioned results show that a solvent capable of highly dissolving polyetherpolyol is preferable as a washing agent for the foam. As a result of a search for good solvents for the polyetherpolyol, it was found that the above-mentioned monohydric alcohols and alkylethers of polyhydric alcohols were particularly preferable. In the dissolution of impurities, ethanol was used, and it was also found that water had a solubility for the impurities, though not high, and thus a solvent mixture with water was also effective, as mentioned before.

It was found from the foregoing results and other results that the quantity of impurities in the absorbent member could be effectively determined as a quantity of soluble matters from changes in the peak depth at 1110 $cm^{-1}$ due to the ether bond of polyetherpolyol.

The foregoing procedure is applicable to selection of kinds of the washing agents and washing conditions mentioned above, and thus the appropriate kind of washing agent and washing condition must be selected in view of absorbent members to be used.

Determination by IR spectrum may be made not only with the peak at 1110 $cm^{-1}$, but also with that at 1730 $cm^{-1}$.

The procedure for quantitative determination of soluble matters will be explained in detail below.

For example, one absorbent member is washed with a given amount of a washing agent under given conditions, and then a predetermined amount of the washing solution is sampled and evaporated to dryness. Then, the residues are formed in a KBr tablet for the infrared spectroscopy, and the tablet is inserted into an infrared spectrometer to obtain a spectrum. A peak depth at 1110 $cm^{-1}$ is recorded. On the other hand, predetermined amounts of polyetherpolyol are sampled and formed into KBr tablets and their infrared absorption spectra are obtained, and their peak depths at 1110 $cm^{-1}$ are recorded. By preparing a calibration chart between the amount of polyetherpolyol and the peak depth from the peak recordings, a quantity of soluble matters can be obtained on the basis of different washing conditions.

Figure 16:
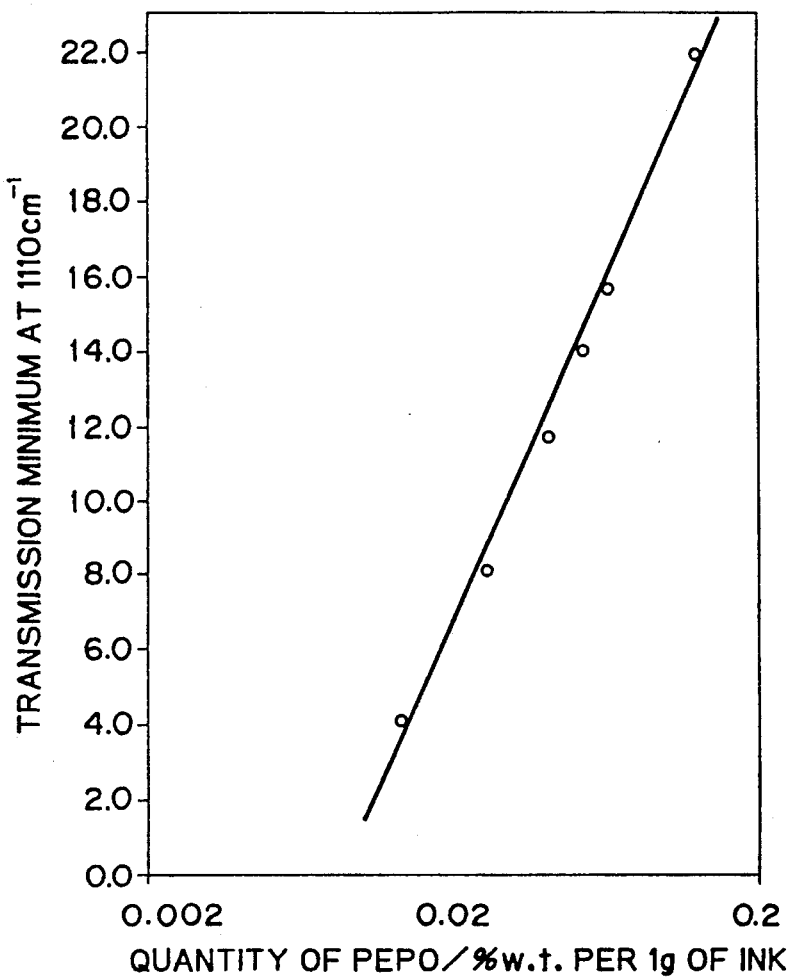
FIG. 16 is a calibration curve of polyether polyol.

FIG. 16 shows one example of the calibration chart.

Relations between the measurements by the foregoing procedure for the quantitative determination with the peak at 1110 $cm^{-1}$ in the IR spectrum for polyetherpolyol as an impurity, and the physical properties of ink will be explained below.

Inconveniences appearing when an unwashed absorbent member is used are a decrease in the surface tension as one of ink physical properties, to, for example, less than 40 dynes/cm, and deterioration of recording quality. Particularly, an OD decrease in the recording quality, ink permeation to the back side of paper and spreading of ink in a whisker state around the recording dots appear, resulting in deterioration of sharpness in the recording (irregular blurrings). In order to suppress the deterioration of the recording quality and the decrease in the ink surface tension, it is desirable that the amount of impurities (soluble matters) be not more than 0.04% by weight, preferably not more than 0.03% by weight per gram of ink, as will be explained later. The amount of impurities per gram of ink means an amount of impurities dissolved into ink per gram of ink in the ink tank.

As will be described later, above 0.04% by weight, the deterioration of recording quality gradually proceeds during the immersion of an absorbent member in ink for a long time, and thus the recording quality is deteriorated after 2 or 3 years, though it is relatively high in the initial period. At not more than 0.04% by weight, no deterioration is observable in the recording quality even if the absorbent member is immersed in ink for 2 to 3 years, and the decrease in the ink surface tension can be suppressed to a minimum. That is, it is not less than 40 dynes/cm.

Relations between the quantity of soluble matters from an absorbent member and the recording quality can be determined by preparing absorbent members having various quantities of soluble matters in advance and quantitatively determining the quantities of dissolved matters according to the above-mentioned procedure for quantitative determination by infrared absorption spectroscopy.

As to the standard for the cleaning degree of an absorbent member, i.e., concentration of impurities of not more than 0.04% by weight per gram of ink, the quantitative determination of polyether polyol is preferred from the viewpoint of simpleness, reliability, etc. of determination procedure. So far as the above-mentioned polar solvent is used as a washing agent, washing can be carried out on the basis of a similar standard by determining the dissolved matters as a weight change simply through evaporation of the dissolved matters-containing fraction to dryness (50° to 90° C.). Besides the procedure for determining polyether polyol by the peak at 1110 $cm^{-1}$, total of polyether polyol and dioctyl phthalate can be quantitatively determined from combination with other peaks, e.g. peak at 1730 $cm^{-1}$, where the determination can be easily made by preparing a necessary calibration chart for it in advance.

The washing step of the present example in the preparation of an absorbent member will be explained below.

The washing step of the present example can be carried out after the step of cutting the ink-absorbent member to the prescribed size.

Although the absorbent member after the cutting step is selected in view of the size of the ink storing portion wherein the absorbent member is stored, the absorbent member is usually about 20 to about 35 mm in thickness and about 5.5 to about 6.5 g/piece in weight is suitable for washing.

As described later, other methods may be acceptable as the necessary condition of the present invention eluted impurity from the ink-absorbent member the prescribed that or less. Usually, on the polar solvent, one run of the washing is satisfactory, and preferably one washing is repeated with a fresh washing solution after the washing with the predetermined amount of the solvent. After the washing with the washing agent, the washing agent contained in the absorbent member is squeezed out and directly dried with heating or rinsed with pure water, and the water contained in the absorbent member is squeezed out, followed by drying with heating, and so forth. Such processes as mentioned above are satisfactory.

The amount of a washing agent for use in the washing is preferably 4 ml or more to 10 ml/gram or less of the absorbent member so as to improve the cleaning efficiency. Less than 4 ml/gram of the absorbent member, the washing is not satisfactory, resulting in increased runs of washing and increased time with a poor efficiency, whereas more than 10 ml/gram of the absorbent member, the amount of the solvent is too large with no corresponding washing effect and a poor cost efficiency.

Satisfactory washing time is usually as few as ten seconds to minutes in case of polar solvents. In case of washing by rubbing or repeated pressing, a few ten seconds are satisfactory. After the washing, drying is carried out preferably in a hot air drier at 40° to 100° C., preferably at 50° to 70° C., because drying at a high temperature may lead to deterioration of the quality of the absorbent member. An appropriate drying time is 3 to 6 hours. In any way, appropriate washing conditions must be preset by the above-mentioned IR spectroscopic procedure to make the amount of impurities not more than 0.2% by weight per gram of the ink absorbent member by washing. The washing step can be systematized thereby.

The present absorbent member is a foamed member having a predetermined porosity prepared according to the predetermined process as mentioned above, followed by heat pressing to a predetermined compression ratio and cutting to a predetermined size. In the heat pressing step the size is compressed to one-half to one-fifth of the original size usually at a temperature of 180° C. to 210° C. It has been found by the IR spectroscopic procedure that the thus obtained absorbent members have varied contents of eluted impurites, depending on the cutting positions of a foamed block before the heat pressing. This finding was not known before and is very important for stably preparing absorbent members of constant quality. Such uneven distribution of impurities can be met, as mentioned above.

Changes with time in the recording quality can be determined by an accelerated test based on preservation at 60° C. for 1 to 3 months, which corresponds to the preservation at room temperature for 1 to 3 years. That is, by inserting the absorbent member into an ink jet cartridge and keeping the cartridge in an oven at 60° C., and recording the data at every month, the changes with time in the recording quality can be determined.

Experiments were carried out under various washing conditions to determine relations between the content of remaining eluted impurities after the washing (hereinafter referred to as "eluted quantity") and changes with time in the recording quality.

(1) EXPERIMENT 1

Example 1

There were prepared two absorbers (absorbent members), which were obtained by taking out a part of the center of a polyurethane foaming block obtained by a routine method, effecting hot-press at 200° C. for compressing the part to one third, and cutting out a rectangle chip of a weight of 6 g. The two absorbers were press-washed in 80 cc of ethanol ten times (about 0.5 to 1 minute in total), and ethanol penetrated into the absorbers was pressed out to obtain the washed absorbers and the waste ethanol washing solution. A 0.2 ml sample was taken from the obtained waste ethanol washing solution and evaporated to dryness. The residue was thoroughly ground and mixed in an agate mortar, together with 200 mg of the KBr powder for infrared absorption spectrum. According to a routine method, the KBr powder obtained was prepared into a KBr tablet for infrared absorption spectrum, by means of a KBr tablet machine. The infrared absorption spectrum of the tablet was measured by an IR spectrometer Type HITACHI 270-30, to read out its peak depth at 1110 $cm^{-1}$ by a routine method. By using the value, the amount of extract was calculated on the basis of the calibration curve in FIG. 16. The two washed absorbers were then placed and press-washed in 200 cc of pure water ten times. The absorbers were pressed and then dried in hot air in an oven at 60° C. for 5 hours. One of the resulting washed absorbers was placed subsequently in 40 cc of ethanol, and by following the same procedure at the initial stage, the extract amount in the ethanol washing solution was measured by infrared absorption spectroscopy. The total amount of the extract described immediately above and the extract described further above was defined as the contact of the initial eluted matters (total extract). The remaining one absorber was inserted into an ink cartridge for constructing an inkjet head, which was then subjected to a recording test. The recording test was performed at ambient temperature and humidity, initially and after the storage at 60° C. for one month, two months and three months. The OD value, strike-through of ink, and quality (irregular bleeding of dots) were then evaluated as compared with those at initial stages. The storage at 60° C. for three months corresponds to the storage at ambient temperature for three years.

The standard for evaluation was as follows:

◎: no change

○: small change (within the allowable limit)

Δ: medium change (beyond the allowable limit)

X: large change.

The results are shown in Table 5.

As a result, the impurities remaining after the washing were 0.07 wt % per g of ink absorber. No effect on ink quality was observed even after the storage for three months.

Example 2

Three absorbers of the same type as in Example 1 were used. One of them was washed in ethanol as in Example 1, and the total amount of extract in the washing solution was measured. The remaining two were washed in a washing solution of a weight ratio of isopropyl alcohol to water of 1:1, by the same method as in Example 1. One of the absorbers obtained after the washing was further washed in 40 cc of ethanol in the same manner as in Example 1, and the amount of extract in the washing solution was measured. The remaining one absorber after the washing was incorporated in an inkjet head as in Example 1, which was then subjected to the recording test. The results are shown in Table 5.

Consequently, the impurities remaining after the washing were 0.1 wt % per g of ink absorber. No effect on ink quality was observed even after three-month storage.

Example 3

By employing as a washing solution the mixed solvent of methyl cellosolve and water of a weight ratio of 1:1 instead of the mixed solvent of isopropyl alcohol and water of Example 2, washing was carried out following the same procedure in its entirety as in Example 2. The recording test was then carried out. The results are shown in Table 5.

Consequently, the impurities remaining after the washing were 0.09 wt % per g of ink absorber, and no effect on ink quality was observed after three-month storage.

Example 4

By employing absorbers obtained by taking out a part of the lower part of a polyurethane foaming block, effecting hotpress at 200° C. for compressing the part to one-third, and cutting out a rectangle chip of a weight of 6 g, washing was done, completely following the same method of Example 1. The amount of extract was then measured. The recording test was subsequently carried out. The results are compiled and shown in Table 5.

As a result, the impurities remaining after the washing were 0.15 wt % per g of ink absorber. A slight change was observed in ink quality during three-month storage, but it was within the allowable limit. Thus, it did not cause any problem.

Example 5

One of the same absorbers as in Example 2 was washed in ethanol, and the total weight of extract in the washing solution was measured. The remaining two absorbers were washed in the washing solution used in Example 2, and ultrasonic cleaning was employed as the washing method. By using a 100-W ultrasonic cleaner Type RU-30C, washing was effected for two minutes. By the same manner as in Example 2, the extract amount was measured while the recording test was done. The results are compiled and shown in Table 5.

Consequently, the impurities remaining after the washing were 0.12 wt % per g of ink absorber, and no effect of ink quality was observed after three-month storage.

Example 6

The same washing procedure was carried out two times, instead of once in Example 5. Then, two washed absorbers were obtained. One of them was press-washed in 40 cc of ethanol ten times, and the waste ethanol washing solution was obtained. A 0.2 ml sample was taken from it, and its infrared absorption spectrum was measured in order to calculate the extract amount as in Example 1. The remaining one was incorporated into an inkjet head. The results of the recording test performed in the same manner as in Example 1 are compiled and shown in Table 5.

Consequently, the impurities remaining after the washing were 0.03 wt % per g of ink absorber, and no problem concerning long-term storage of the ink absorbers was observed.

Example 7

By employing absorbers obtained by taking out a part of the lower part of a polyurethane foaming block, effecting hotpress at 200° C. for compressing the part to one-third, and cutting out a rectangle chip of a weight of 6 g, washing was carried out as in the same manner as in Example 2, and the amount of extract was measured. The recording test was subsequently carried out. The results are compiled and shown in Table 5.

As a result, the impurities remaining after the washing were 0.19 wt % per g of ink absorber. Even after two-month storage, the change in ink quality was within the allowable limit.

Example 8

By employing absorbers obtained by taking out a part of the lower part of a polyurethane foaming block, carrying out hot-press at 210° C. for compressing the part to one-third, and effecting washing as in the same manner as in Example 7, the amount of extract was measured. The recording test was then carried out. The results are compiled and shown in Table 5.

As a result, the impurities remaining after the washing were 0.20 wt % per g of ink absorber. After two-month storage, the change in ink quality was within the allowable limit.

Comparative Example 1

Absorbers as used in Example 1 were assembled into an ink-jet head without washing to carry out the recording test. The results are compiled and shown in Table 5.

Consequently, the change in ink was distinct after one-month storage, so it was not permissible.

Comparative Example 2

Absorbers as used in Example 4, but not through washing process, were assembled into an ink-jet head to carry out the recording test. The results are compiled and shown in Table 5.

Consequently, the change in ink was already evident at the initial evaluation.

Reference Examples

Absorbers as used in Example 1 were washed in ethanol three times following the same method in Example 1. Five absorbers obtained through thorough washing were prepared (Nos. 1 to 5) and assembled individually into ink-jet heads. To the absorbers of Nos. 1 to 4 were added polyether polyol (propylene oxide adduct of glycerine, having a molecular weight of about 6000) at a ratio of 0.1 wt %, 0.15 wt %, 0.2 wt % and 0.25 wt % per g of absorber, respectively.

No-additive ink was added to the absorber No. 5, for carrying out the recording test. The results are complied and shown in Table 5.

Consequently, a tendency similar to the results of the examples of the present invention was observed. The effect of the loadings of the eluted impurities above 0.2 wt % per g of absorber on ink was not permissible.

From the results of the experiments above, it is thus demonstrated that there can be obtained ink absorbers with no enviromental problem and without deteriorating the recording quality, by carrying out washing with a washing agent containing an organic solvent of a polarity, the organic solvent having no reactivity with ink absorbers, in such manner that the elution amount should be 0.2 wt % or less per g of ink absorber.

(2) EXPERIMENT 2

Correlation of the amount of polyether polyol eluted from an ink absorber into an ink with the recording quality was examined.

Figure 17:
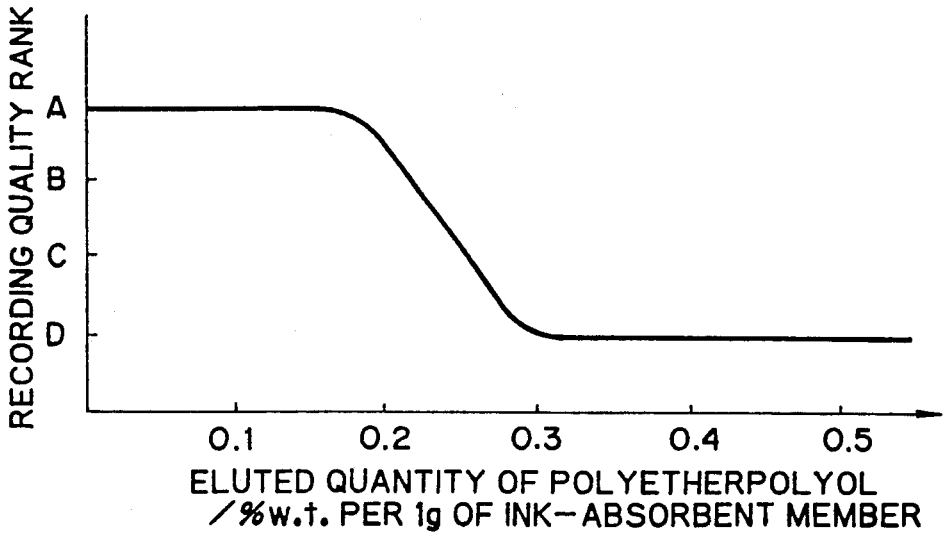
FIG. 17 is a characteristic figure representing the relation between the extract amount of polyether polyol and the recording quality.

Ink absorbers (ether-type foaming polyurethane) were individually prepared, with varying amounts of organic matters (polyether polyol) eluted into an ink as shown in FIG. 17. These ink absorbers were prepared, by hot-press under various conditions so as to compress the ether foaming polyurethane to one third and cutting.

These ink absorbers were individually charged into ink tanks of inkjet cartridges to allow them to absorb and keep 30 $cm^3$ of ink maintained at pH 7–10. They were then left to stand for a while. Subsequently, recording was done by using these ink-jet cartridges. Recording quality was then evaluated, and the amount of organic matters (polyether polyol) eluted into ink was measured. The weight of each of the ink absorbers was 6 g.

As has been described above, the amount of eluted polyether polyol was determined by infrared absorption spectroscopy. Such determination was also carried out by high-performance liquid chromatography described hereinbelow. A liquid chromatography system Shodex Type ds-3 was used, while a column of Shodex Type B-806 of an ion exchange type was employed. A detector Shodex Type RI SE-51 of a refractive index type was used. A solvent of methanol and water of 6:4 was used, and its flow rate was 1 ml/minute. The eluted quantity shown in FIG. 17 is calculated based on the weight (6 g) of the ink absorber.

The overall recording quality was evaluated with respect to the decrease in optical density due to ink bleeding (feathering) and strike-through (ink penetration toward the back of paper when the entire surface was recorded in black). The evaluation divided in 4 stages of A to D was carried out, according to the method of functional test. A, B, C and D correspond to the levels excellent, good within the allowable range of recording quality, poor outside the allowable range of recording quality, and considerably poor, respectively (FIG. 17).

FIG. 17 shows that the deterioration of recording quality cannot be induced if the amount of eluted polyether polyol is 0.2 wt % or less per g of ink absorber and thus satisfactory recording quality can be maintained. If the amount of eluted polyether polyol exceeds 0.2 wt % per g of ink absorber, recording quality is dramatically deteriorated.

The Experiments 1 and 2 demonstrate that the deterioration of recording quality is not induced if the amount of polyether polyol eluted into an ink is 0.2 wt % or less per g of ink absorber.

The method of prescribing pH of ink to be impregnated into the absorbent member as mentioned in (iii) will be explained below.

(3) EXPERIMENT 3

Figure 18:
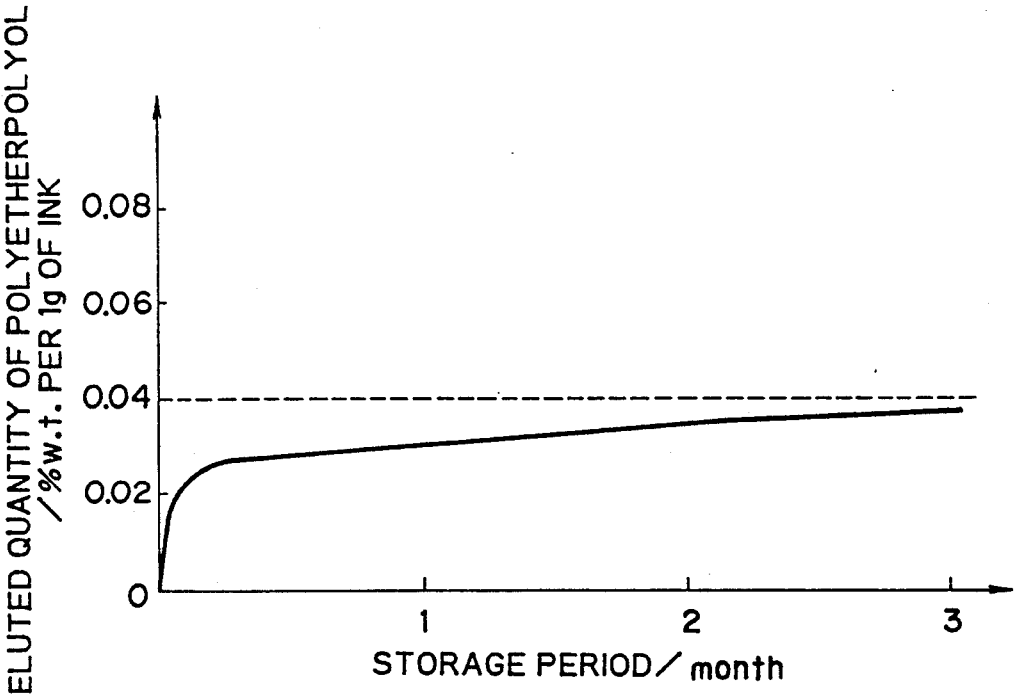
FIG. 18 is a characteristic figure representing the relation between the extract amoung of polyether polyol and the storing time.

By the same manner as in Example 2, an ink absorber with an extract amount of 0.2 wt % per g of ink absorber was charged with an ink tank to allow the absorber to be impregnated with ink maintained at pH 7 to 10. Regarding the ink-jet cartridge, the relation between the storage period at a temperature of 60° C. and the amount of polyether polyol eluted into ink was examined. The method for measuring the eluted quantity is the same as in Example 1. The results are shown in FIG. 18. The storage at 60° C. for one month corresponds to the storage at room temperature for one year.

As is apparent from the results, the elution amount of polyether polyol gradually increases under long-term storage, but does not exceed 0.2 wt % per g of ink absorber for a period of at least about 3 years which is the converted period at room temperature.

Based on the result of the experiment on the above (ii) carried out by the present inventors, there will be explained the relation between the heating compression (also referred to as "hot press") temperature of an ink absorber using ether-type foaming polyurethane in accordance with the present invention and the extract amount of polyether polyol. In the following Examples 4 to 7 and Comparative Example 3, the term ether-type foaming polyurethane represents a product produced by the process comprising, employing propylene oxide adduct of glycerine, having a molecular weight of about 6000, and toluenes diisocyanate as polyether polyol and diisocyanate, respectively, polymerizing and foaming these materials by a known method, forming them into open cells by a known membrane-removing process, and cutting out the cells into a preset thickness.

(4) EXPERIMENT 4

The correlation between the amount of polyether polyol extracted from an ink absorber into an ink and the recording quality was examined.

An ether-type foaming polyurethane was hot-pressed to compress it to one-third at each temperature of 210°, 200°, 190° and 180° C., which was then cut out into ink absorbers. The individual tank absorbers were charged in ink tanks of ink-jet cartridges, and allowed to absorb and keep 30 $cm^3$ (about 30 g) of ink. After the absorbers were left to stand for a while, recording was effected by using these ink-jet cartridges. The recording quality was evaluated, to measure the amount of polyether polyol extracted into the ink at that time. The weight of each of the ink absorbers was 6 g.

Overall recording quality was evaluated with respect to the decrease in optical density due to ink bleeding (feathering) and strike-through (ink penetration toward the back of paper when the entire surface was recorded in black). According to the method of functional test, the evaluation divided in 4 stages of A to D was carried out. A, B, C and D correspond to the levels excellent, good within the allowable range of recording quality, poor outside the allowable range of recording quality, and considerably poor, respectively.

The extract amount of polyether polyol was determined by high-performance liquid chromatography, and was represented by the concentration by weight per weight of ink absorber. A liquid chromatography system of Shodex Type DS-3 was used, while a column of Shodex Type B-806 of an ion exchange type was used. A detector, Shodex Type R1 SE-51 of a refractive index type, was used. A solvent of methanol and water of 6:4 was used, and its flow was 1 ml/minute.

The results are shown in FIG. 17. It is apparently shown in the graph of Experiment 4, that the deterioration of recording quality cannot be induced if the extract amount of polyether polyol is 0.04 wt % or less per ink (0.20 wt % or less per g of ink absorber) and thus satisfactory recording quality is maintained. It is also confirmed, that if the elution amount of polyether polyol exceeds 0.04 wt % per g of ink, recording quality is dramatically deteriorated. Thus, the level 0.04 wt % per g of ink (0.20 wt % per g of ink absorber) was determined as the upper limit of the deterioration of recording quality, concerning the amount of polyether polyol extracted into ink.

(5) EXPERIMENT 5

The correlation between the hot-press temperature and the extract amount of polyether polyol from an ink absorber into ink was examined.

Ink absorbers produced by hot-pressing ether-type foaming polyurethane at various temperatures were prepared, and ink was absorbed into the absorbers as in Example 4 to measure the extract amount of polyether polyol. In order to facilitate the extraction of polyether polyol, the ink absorbers were compressed repeatedly by rubbing and washing. By such procedure, the state is reproducible where the polyether polyol is eluted after a certain period of time has passed from the impregnation and absorption of ink. The results of the measurement carried out on a great number of ink absorber samples are shown in the hatched area of FIG. 19.

As is apparently shown from the results, the elevation of the hot-press temperature increases the extract amount of polyether polyol, and the variation in the production increases if the hot-press temperature exceeds 185° C. On taking account of the variation in the production, it is apparent that the hot-press temperature desirably be 185° C. or less, in order that the extract amount of polyether polyol is below the upper limit (0.04 wt % per g of ink) of the deterioration of the recording quality described above. Such temperature is called as thermal decomposition promoting temperature, which is a critical conditional temperature.

(6) EXPERIMENTAL 6

The correlation between the temperature and the time of hot-press was examined.

Hot-press was performed to compress ether-type foaming polyurethane to one-third at each temperature of 140°, 150°, 160°, 170° and 180° C. The minimum of the hot-press time required for leaving the deformation due to hot-press, was then measured.

Consequently, no effect of hot-press was observed in case that hot-press was carried out at 140° C., or the deformation by hot-press did not remain even if the hot-press was continued for a considerably long time. When the temperature of hot-press was 150° C., the period of hot-press required was 2 hours; when the temperature of hot-press was 160° C., the period for hot-press was 90 minutes; the temperature of hot-press was 170° C., the period for hot-press was 1 hour and when the temperature of hot-press was 180° C., the period for hot-press was 30 minutes. As is thus shown, the hot-press temperature was required to be 150° C. or more.

When the hot-press was carried out at 150° C., distinct spring back was observed. When the hot-press was carried out at 160° C., spring back was slight.

In case that ether-type foaming polyurethane was used as ink absorbers, as is apparent from Experiments 4 to 6 described above, the period for hot-press did not get too long and the extract amount of the polyether polyol was lower if the hot-press temperature was 150° C. or more and 185° C. or less. The recording quality can thus be maintained well, even without a washing process. On taking account of the period for hot-press and the spring back at hot-press, it is found that the hot-press temperature is preferably 160° C. or more and 185° C. or less, more preferably 170° C. or more and 180° C. or less.

(7) EXPERIMENT 7

Figure 20:
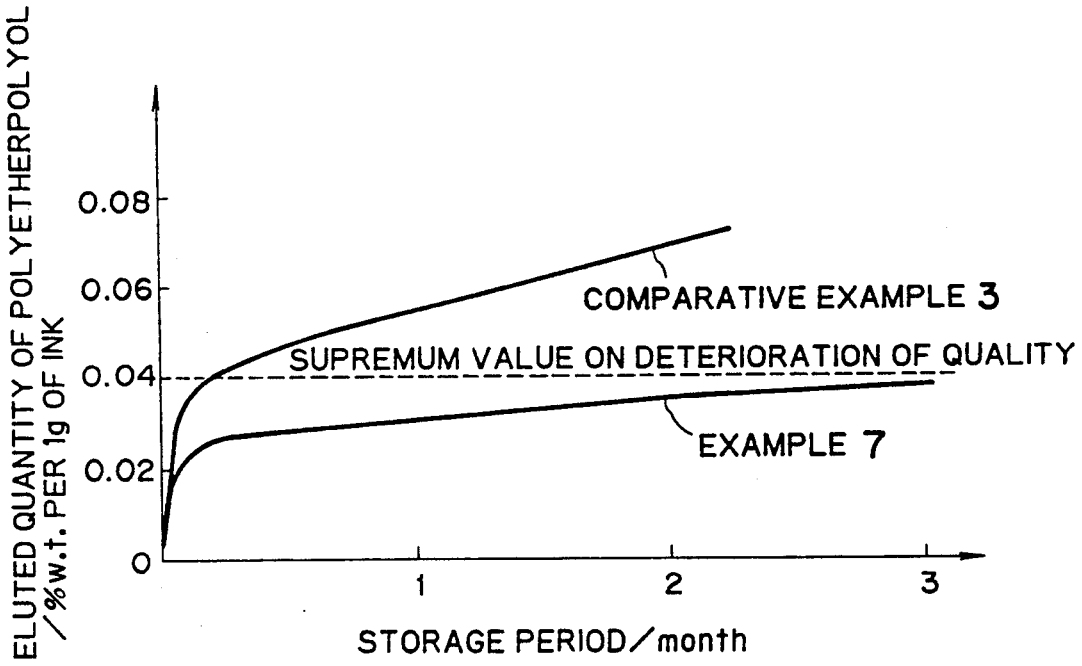
FIG. 20 is a characteristic figure representing the relation between the amount of polyether polyol extracted from the ink absorbers produced by hot-press and the storing time.

The ink absorber, produced by hot-pressing ether-type foaming polyurethane at a temperature of 180° C. for about 30 to 40 minutes while compressing the ether-type foaming polyurethane to one third, was charged in an ink tank. The polyurethane was then allowed to absorb ink, and was maintained at a temperature of 60° C. The relation between the storage period and the eluted quantity of polyether polyol was examined at this state. The method of measuring the eluted quantity was the same as in Experiment 4. The results are shown in the graph of FIG. 20. The storage at 60° C. for one month corresponds to the storage at ambient temperature for one year.

As is apparent from these results, the eluted quantity of polyether polyol increases gradually after a long-term storage. But the eluted quantity does not exceed the upper limit of the recording quality described above (0.04 wt % per g of ink), for a period of at least about 3 years which is the converted period at ambient temperature.

Comparative Example 3

The ink absorber, produced by hot-pressing ether-type foaming polyurethane at a temperature of 190° C. for about 30 to 40 minutes while compressing the ether-type foaming polyurethane to one-third, was measured in the same manner as in Experiment 7. The results are shown in FIG. 20. At an extremely early stage, the eluted quantity of polyether polyol into ink exceeded the upper limit of the deterioration of the recording quality.

Based on the comparison of the results of Experiment 7 with those of Comparative Example 3, it is found that in case that ether-type foaming polyurethane is used as ink absorbers provided that the hot press temperature is 180° C., namely within the temperature range of 150° C. or more and 180° C. or less, the extract amount of polyether polyol does not exceed the upper limit of the deterioration of the recording quality even after long-term storage, so that excellent recording quality is stably maintained. Alternatively, the hot press at a temperature beyond the temperature range of 150° C. or more and 180° C. or less (Comparative Example 3) causes the extract amount of polyether polyol above the upper limit of the deterioration of the recording quality during the process of long-term storage. The deterioration of the recording quality therefore can be known.

The explanation of the examples described above has been stated, regarding the ink-jet cartridge in which an ink tank and a recording head are integrated. The present invention is not limited to the examples, however. It is applied to an ink-jet recording system, in which an ink absorber comprising a porous layer is placed in an ink tank although the ink tank and a recording head are formed in separate structures.

As has been described above, the effect of the present invention can be brought about by simply employing any one of 1) the method of washing absorbers, 2) the method of selecting a heating temperature during a heating and compressing process of absorbers, and 3) the method of specifying the pH of the ink for impregnating the absorbers, as the method for reducing the extraction of impurities into ink. However, it is needless to say that the effect of the present invention can be realized by any appropriate combination thereof.

On further taking into account the actual mode of using the ink-jet cartridge placing the absorbers, for example, in case that an ink-jet cartridge is frequently used and ink is used up for a relatively short period, the method 1 or 2, or the combination of 1 and 2 is preferable; the combination of 1, 2 and 3 is more preferable. In case of using an ink-jet cartridge after long-term storage as another mode of its use, the method 3 hereinabove mentioned is preferable, but the combination of the methods 1 and 3, or the combination of the methods 2 and 3, is more preferable. Furthermore, the combination of the methods 1, 2 and 3 is the most preferable.

The above working examples are further explained below as summarized.

There has been found a certain quantitative relation between the urethane-base absobent member used in the present invention and ink impregnated thereinto. This is explained below in detail.

In the following explanation, apparent volume of the absorbent member inserted in the ink storing section is represented as Vf, dry weight as Wf, and the weight of ink impregnated in the absorbent member is represented as Wi.

1) The ink jet cartridge or ink tank itself in the embodiments of the present invention is constituted as arranging the ink storing section directly connected to the ink jet head 12, i.e. so-called on carridge type. One of the features of this type ink jet cartridge is that water head difference from the head 12 is small.

In this case, feeding and holding of ink is determined by the balance between the surface tension assigned to the meniscus at the tip portion of the nozzle and the negative pressure assigned to the ink absorbent member in the ink storing section.

Since the surface tension by meniscus is considered constant depending to the nozzle structure, a negative pressure corresponding thereto is applied to the ink absorbent member. The negative pressure of ink absorbent member varies depending on the ink amount impregnated therein, that is, it decreases as the ink amount increases and it increases as the ink amount decreases. Therefore, in order to accomplish smooth ink feeding and hold ink without causing ink leaking by change of atmospheric condition, there exists an upper limit and an lower limit in the ink amount to be contained.

Based on this way of consideration, an exemplary limitative absorbent member shown in the above examples, i.e. an ink absorbent member pressed to one-third of the inherent volume and having a dry weight Wf, was used and Wi of ink was injected thereto to give a suitable negative pressure. In this case, Wi/Wf was approximately five.

Therefore, it is clear that if the amount of extractable matter in the ink absorbent member is 0.2 wt % or less per g of absorbent member, the extracted amount of ink does not exceed 0.04 wt %.

2) Even taking into account the process of injecting ink into the above ink absorbent member, the above upper limit of extracted amount still found to be good. That is, in case of injecting ink to the ink absorbent member having an weight Wf from the atmosphere-communication opening or other portion, it is necessary to once evacuate and fill up to the tip of the nozzle with ink to thereby form an ink feeding path, but in this operation, more than Wi, the amount to be eventually held, of ink was injected (i.e. more than 5 Wf of ink was contacted to the ink absorbent member), and the impurity extracted amount to ink was below 0.04 wt %.

3) On the other hand, in case of injecting ink via the ink feeding opening 1200 before attaching the ink jet unit 13, it is considered preferable to evacuate in the same manner and then inject a predetermined amount Wi' of ink. This is because in this case, since an ink feeding path is necessarily formed near the feeding tube, the step of flooding once is not needed. Accordingly, though W' is less than Wi, if the injection amount is below Wi, a portion not containing ink is formed and the weight of absorbent member actually containing ink, i.e. effective weight Wf', is below Wf.

Wf' was calculated as roughly described below.

A container having the same shape and size as the ink tank 14 shown in the working examples were made of a transparent plastic material and a certain amount Wi' of black ink was injected. After the progress of ink impregnation, the whole surface of the tank was observed and the immersion state of each face was measured. By combining these measurements, the volume of immersed portion was calculated. From this value, together with the apparent volume Vf of the ink absorbent member and the dry weight of the same absorbent member Wf, Wf' was calculated according to the following equation:

$$Wf = (Vi/Vf)Wf \quad \text{(A)}$$

Wf' values were calculated with changing Wi' little by little and the values of Wi'/Wf' were approximately 5. Also in this case, the impurity extracted amount did not exceed 0.04 wt %.

Next, the ink absorbent member inserted in the ink storing section at a pressed ratio other than the aforementioned case of pressing the ink absorbent member to one-third of its inherent volume.

4) The apparent volume of the ink absorbent volume pressed to one-third of its inherent volume is represented by Vf, and its dry weight is represented by Wf. The ink absorbent member pressed to 1/n was cut into an apparent volume Vf and its dry weight Wfp was found as follows:

$$Wfp=(n/3)Wf \quad (B)$$

At this time, ink was injected so as to give a suitable negative pressure and the injected amount Wip gave a suitable negative pressure.

In case of $n<3$, approximately $$Wip=(n/3)Wi \quad (C)$$

and in case of $n>3$ $$Wip=(n/3)Wi \quad (D)$$

were obtained.

The result of (D) can be interpreted to be that as the rate of compression rises, vacant pores become smaller significantly and the negative pressure of ink becomes very higher, thereby necessitating to inject a larger amount of ink into the ink absorbent member to obtain a suitable level of negative pressure as compared to the case of compression to one-third.

Thus, the relation $$Wip/Wfp \geqq Wi/Wf=5 \quad (E)$$

was obtained and consequently, the extracted amount of impurity into ink could be kept below 0.04 wt %.

5) Further, an experiment was performed in the same manner using the ink absorbent member having a different pore size, and it was found that the primary controlling factor was the same as the above (4).

Figure 19:
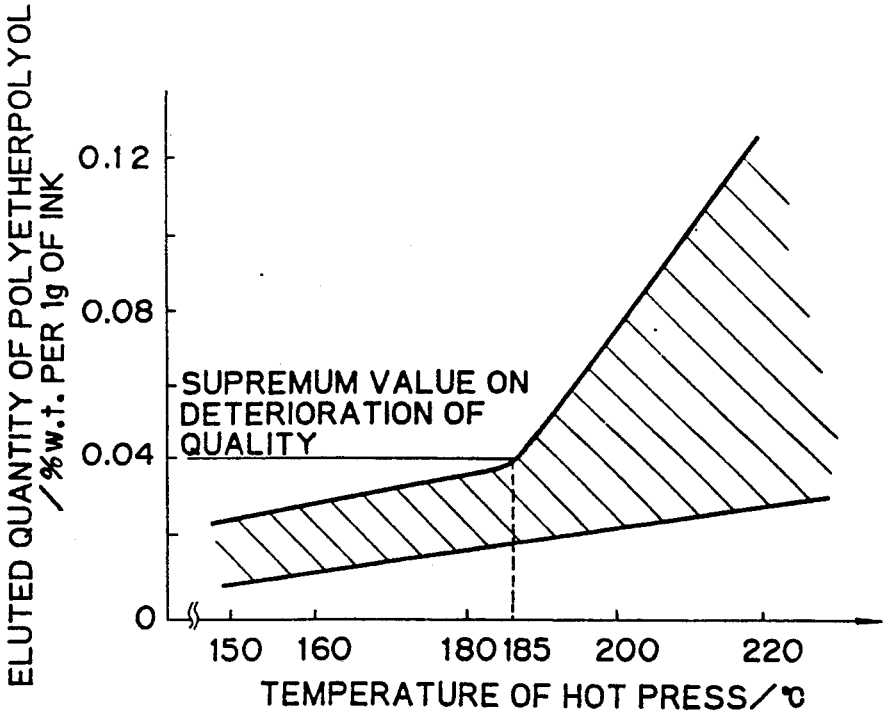
FIG. 19 is a characteristic figure representing the relation between the temperature of hot-press and the extract amount of polyether polyol.

Further, the ink cartridge 11 may be used as in the manner shown in FIG. 19 that the ink storing section is refilled with ink by using an ink filler 6000. For refilling, ink may be injected via the atmosphere-communicating opening 1401 of the ink cartridge, or otherwise it may be injected via the ink feeding opening on the head side or the hole provided on the ink cartridge.

Figure 22:
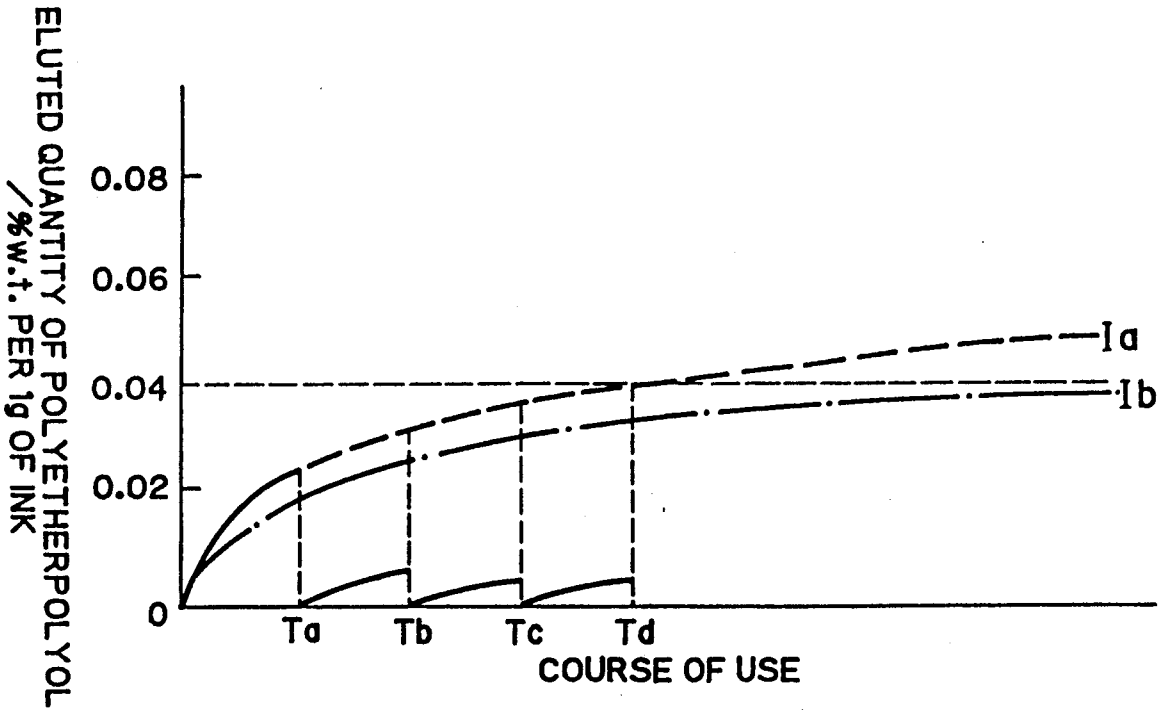
FIG. 22 shows a concentration change of polyether polyol in ink within an ink storing section with reference to the time lapse of use.

In this regard, one of the knowledges from the working example mentioned above that the recording quality is not deteriorated if the extracted (eluted) amount (quantity) of polyether polyol into ink is 0.04% by weight or less per 1 gram of ink, is applied to establish a further suitable examples of the embodiments in the use of an ink cartridge 11 as shown in FIG. 22.

FIG. 22 shows a concentration change of polyether polyol in ink within the ink storing section with reference to the time lapse in case of using it in such a manner.

Now, explanation is given as illustrating an ink in which the extracted amount of polyether polyol into the ink exceeds 0.04% as time passes as shown in Ia of FIG. 22.

Figure 21:
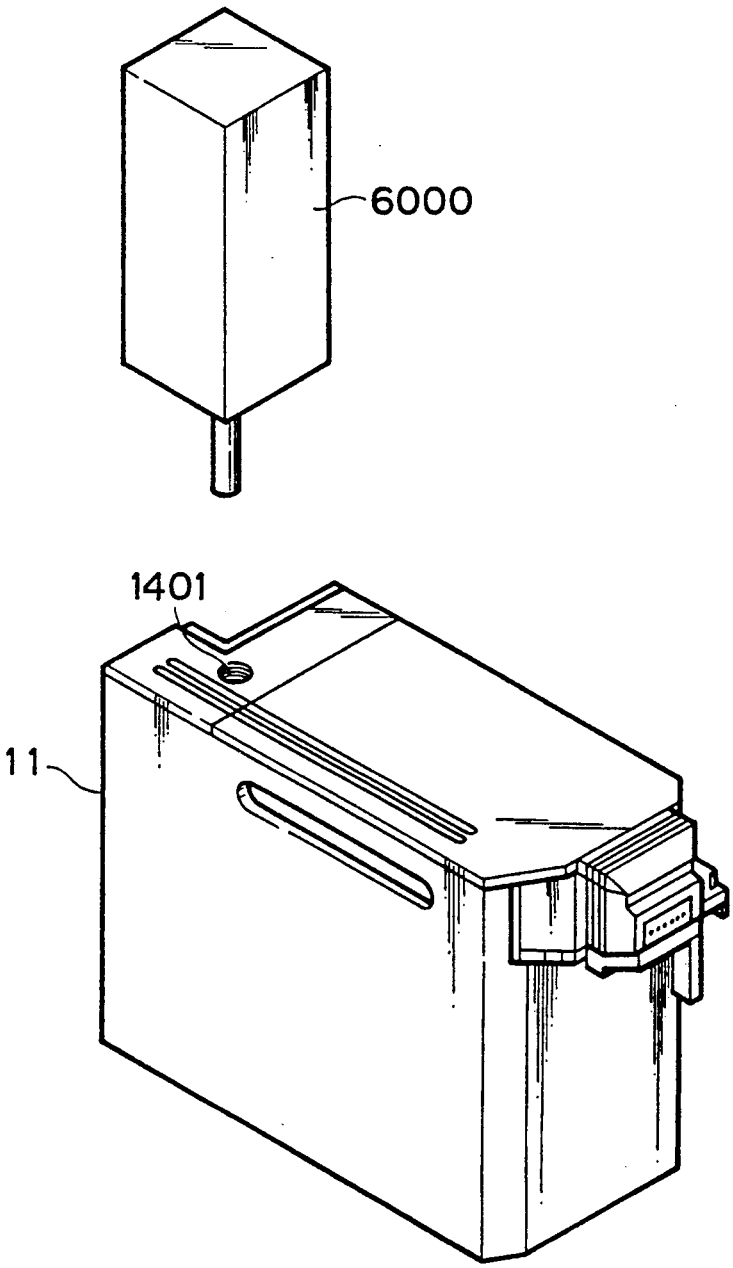
FIG. 21 shows an ink cartridge of which ink storing section is refilled with ink by using an ink filler.

At the time point of Ta of FIG. 22, since the ink using amount is large, ink is almost consumed before the aforementioned extracted amount exceeds 0.04% that is the upper limit of recording quality deterioration, and ink refilling is performed as shown in FIG. 21. Further, ink is again consumed at Ta of FIG. 22 and next ink filling is performed. In a similar manner, consumed ink refilling is performed at Tc and Td, respectively. In doing this, the extracted amount of polyether polyol does not exceed 0.04 wt % that is the upper limit of recording quality deterioration as aforementioned as shown by the solid line in FIG. 22. Accordingly, even such an ink exceeding the upper limit of recording quality deterioration as being used could accomplish recording with a high recording quality in case of employing a using method as described above.

Further needless to say, in case of using an ink in which the extracted amount of polyether polyol into the ink does not exceed 0.04 wt % that is the upper limit of recording quality deterioration as being used, as shown in Ib of FIG. 22, the aforementioned use method never exceeds 0.04 wt % and therefore, recording with a high recording quality can always be effected.

Accordingly, both the absorbent member itself and the ink containing absorbent member of the present example are particularly effective in a form being sold as a unit having an ink filler 6000 as shown in FIG. 21.

The ink-absorbent member may be prepared from cellulose or a cellulose derivative.

Further, the ink-absorbent member may be prepared from foamed polyurethane produced by use of a propylene oxide adduct of sucrose as the polyetherpolyol for the polyol.

Further, the ink-absorbent member may be prepared from foamed polyurethane produced by use of an ethylene oxide-propylene oxide adduct of sucrose as the polyetherpolyol for the polyol.

Further, the ink-absorbent member may be prepared from foamed polyurethane produced by use of a propylene oxide adduct of an aromatic amine as the polyetherpolyol for the polyol.

Further, the ink-absorbent member may be prepared from foamed polyurethane produced by use of an ethylene oxide-propylene oxide adduct of an aromatic amine as the polyetherpolyol for the polyol.

Further, the ink-absorbent member may be prepared from foamed polyurethane produced by use of a propylene oxide adduct of an aliphatic amine as the polyetherpolyol for the polyol.

Further, the ink-absorbent member may be prepared from foamed polyurethane produced by use of an ethylene oxide-propylene oxide adduct of an aliphatic amine as the polyetherpolyol for the polyol.

Ink for use in the present invention may be either aqueous or non-aqueous. Aqueous ink is preferably used. An aqueous ink is basically composed of water, a water soluble organic solvent, an additive, and a coloring matter. The organic solvent includes polyhydric alcohols, glycol ethers, nitrogen-containing solvents, lactones, aliphatic monohydric alcohols, and the like. Among them, particularly preferably polyhydric alcohols are glycerin, diethylene glycol, ethylene glycol, polyethylene, glycol, thiodiglycol, 1,2,6-hexanetriol, and the like. Particularly preferable glycol ethers are triethylene glycol monomethyl ether, and the like. Particularly preferable nitrogen-containing solvents are N-methyl-2-pyrrolidone, 2-pyrrolidone, 1,3-dimethyl-2-imidazolidinone. Particularly preferable lactones are γ-butyrolactone, and the like. Particularly preferable aliphatic monohydric alcohols are ethanol, isopropyl alcohol, and the like. Generally these solvents are combinedly used. As the additive, a surfactant, a pH controller, a mildew-proofing agent, and so forth are used. As the coloring matter, a water-soluble dye or pigment may be used, among which water-soluble dyes, especially acidic dyes, direct dyes, and basic dyes are preferable. In the preferable composition of these constituent, water is contained at a content ranging from 70 to 95% by weight, more preferably from 75 to 90% by weight; the water-soluble organic solvent from 3 to 40% by weight, more preferably from 3 to 20% by weight, still more preferably from 5 to 15% by weight; the coloring matter from 0.5 to 10% by weight, more preferably from 1 to 6% by weight; and the additive from 0.01 to 1.0% by weight. As the preferable properties of ink, the viscosity is in the range of from 1 to 4 cp, more preferably 1 to 3 cp; the surface tension from 35 to 65 dyn/cm, and pH from 3 to 10.

The present invention is applicable to recording heads, and recording apparatuses of ink-jet recording systems, especially of ink-jet systems which employ thermal energy to form flying droplets and conduct recording therewith.

The ink-jet recording systems is constituted and utilized preferably based on the principle disclosed in U.S. Pat. No. 4,723,129 and U.S. Pat. No. 4,740,796. This system is useful both in on-demand types and in continuous types. Particularly it is useful in the on-demand types in which at least one driving signal for giving rapid temperature rise exceeding nuclear boiling temperature corresponding to recording information is applied to an electro-thermal transducer placed in proximity to a sheet or a liquid flow path where liquid (ink) is held, whereby thermal energy is generated in the electro-thermal transducer to cause film boiling on the heating face of a recording head, and consequently bubbles are formed in the liquid (ink) corresponding to the driving signal. The growth and constriction of the bubbles drives the ink to eject through ejection opening, and at least one droplet is formed. A pulse shape of driving signal is preferable since the growth and constriction of the bubbles is made instantaneously and suitably, and ink is ejected with high responsiveness.

Suitable pulse shape driving signals are such that are described in U.S. Pat. No. 4,463,359, and U.S. Pat. No. 4,345,262. Further better recording can be conducted by employing the conditions described in U.S. Pat. No. 4,313,124 regarding the invention on the temperature rise rate on the heating face.

The present invention is applicable to the constitution of recording heads having heating portions placed at bending portions as disclosed in U.S. Pat. No. 4,558,333 and U.S. Pat. No. 4,459,600 in addition to the constitution composed of ejection openings, liquid flow paths, and electro-thermal transducer (linear liquid flow paths or rectangular liquid flow paths).

The present invention is also applicable to the constitution having a slit as an ejection portion common to a plurality of electro-thermal transducers as disclosed in Japanese Patent Application Laid-Open No. Sho-59-123670, and to the constitution having an opening for absorbing a pressure wave of thermal energy corresponding to an ejection portion as disclosed in Japanese Patent Application Laid-Open No. Sho-59-138461.

The present invention is also applicable to a full-line type recording head being constituted of a plurality of recording heads for covering the length as shown in the above patent specifications or being constituted of one recording unit formed integrally in one body, corresponding to the maximum breadth of recording mediums.

The present invention is also applicable to an exchangeable chip type recording head which can be electrically connected to the main apparatus body or can receive supply of ink from the main apparatus body when mounted on the main apparatus body, and to a cartridge type recording head having an ink tank integrally with the head.

The effect of the present invention is further ensured by adding a recovery means for the recording head, additional auxiliary means, or the like as constitutional parts of a recording apparatus of the present invention. Specific examples of the means for the recording head are a capping means, a cleaning means, a pressuring or sucking means, a preliminary heating means comprising an electro-thermal transducer or another heating element or combination thereof, and practice of preliminary ejection mode for non-recording ejection.

The present invention is effective not only in one color recording mode using black color or other one color but also recording by an apparatus employing an integrated recording head or a combination of recording heads, and using multiple different colors or full colors by color mixing.

The recording apparatus of the present invention include image output terminals of information-treating apparatus such as word processors and computers provided integrally or separately, copying apparatuses combined with a reader, and facsimile apparatus having functions of sending and receiving information.

As described above, the present invention provides an ink-absorbent member for an ink-jet cartridge which meets requirements on various properties and performs sufficient functions at low cost. According to the present invention, the porous material material can be utilized effectively regardless of the variation of the material, thereby reducing the production cost. Further the porous material can be encased readily in the ink storing portion since the porous material is hot-pressed before the encasing.

In the present invention, compression of the ink-absorbent member constituted of a porous material without heating reduces the amount of impurity eluting out from the ink-absorbent member, whereby an ink-jet cartridge and a recording apparatus employing the cartridge are provided which is capable of maintaining stable recording quality over a long period.

TABLE 1

Effect of Absorbent Member Hardness and Gravity Acceleration

| Absorbent member hardness | Apparent density | Gravity acceleration 0.5 G | 1.0 G | 1.5 G |
|---|---|---|---|---|
| 10 kg · f | 0.10 g/cm$^3$ | X | X | X |
| 15 kg · f | 0.10 g/cm$^3$ | Δ | X | X |
| 20 kg · f | 0.15 g/cm$^3$ | ○ | ○ | ○ |
| 25 kg · f | 0.15 g/cm$^3$ | ○ | ○ | ○ |
| 30 kg · f | 0.20 g/cm$^3$ | ○ | ○ | ○ |

○ No problem
Δ Abnormality at initial stage of recording (on carriage return)
X Poor recording

TABLE 2

| Absorbent member hardness | Apparent density | Recordable sheets 500 or more | Ink leakage on dropping (70 cm) |
|---|---|---|---|
| 20 kg · f | 0.10 g/cm$^3$ | ○ | ○ |
| | 0.15 g/cm$^3$ | ○ | ○ |
| | 0.20 g/cm$^3$ | ○ | ○ |
| | 0.25 g/cm$^3$ | X | Δ |
| | 0.30 g/cm$^3$ | X | X |
| 30 kg · f | 0.10 g/cm$^3$ | ○ | ○ |
| | 0.15 g/cm$^3$ | ○ | ○ |
| | 0.20 g/cm$^3$ | ○ | ○ |
| | 0.25 g/cm$^3$ | X | Δ |
| | 0.30 g/cm$^3$ | X | Δ |

TABLE 3

| | Absorbent member | | | Characteristic of absorbent member | | |
|---|---|---|---|---|---|---|
| No. | r Compression ratio | p Cell number | r · p (inch$^{-1}$) | Continuous recording | Recoverableness | Ink mobility |
| 1 | 3.0 | 20 | 60 | X | X | X |
| 2 | 2.0 | 30 | 60 | X | X | X |
| 3 | 3.0 | 30 | 90 | X | X | X |
| 4 | 4.5 | 20 | 90 | X | X | X |
| 5 | 2.0 | 45 | 90 | X | X | X |
| 6 | 2.0 | 50 | 100 | ○ | Δ | ○ |
| 7 | 2.5 | 40 | 100 | ○ | Δ | ○ |
| 8 | 4.0 | 25 | 100 | ○ | Δ | ○ |
| 9 | 5.0 | 20 | 100 | ○ | Δ | ○ |
| 10 | 3.0 | 40 | 120 | ○ | ○ | ○ |
| 11 | 4.0 | 30 | 120 | ○ | ○ | ○ |
| 12 | 6.0 | 20 | 120 | ○ | ○ | ○ |
| 13 | 3.0 | 50 | 150 | ○ | ○ | ○ |
| 14 | 3.75 | 40 | 150 | ○ | ○ | ○ |
| 15 | 5.0 | 30 | 150 | ○ | ○ | ○ |
| 16 | 4.0 | 40 | 160 | ○ | Δ | ○ |
| 17 | 4.57 | 35 | 160 | ○ | Δ | ○ |
| 18 | 5.33 | 30 | 160 | ○ | Δ | ○ |
| 19 | 9.0 | 20 | 180 | ○ | Δ | ○ |
| 20 | 6.0 | 30 | 180 | ○ | Δ | ○ |
| 21 | 4.5 | 40 | 180 | ○ | Δ | ○ |
| 22 | 10.0 | 20 | 200 | ○ | Δ | ○ |
| 23 | 6.66 | 30 | 200 | ○ | Δ | ○ |
| 24 | 5.0 | 40 | 200 | ○ | Δ | ○ |
| 25 | 11.0 | 20 | 220 | X | X | X |

TABLE 3-continued

| | Absorbent member | | | Characteristic of absorbent member | | |
|---|---|---|---|---|---|---|
| No. | r Compression ratio | p Cell number | r · p (inch$^{-1}$) | Continuous recording | Recoverableness | Ink mobility |
| 26 | 7.33 | 30 | 220 | X | X | X |
| 27 | 5.5 | 40 | 220 | X | X | X |
| 28 | 10.0 | 30 | 300 | X | X | X |
| 29 | 8.57 | 35 | 300 | X | X | X |
| 30 | 7.5 | 40 | 300 | X | X | X |

TABLE 4

| | Absorbent member | | | Characteristic of absorbent member | | |
|---|---|---|---|---|---|---|
| No. | K Volume ratio | p Cell number | K · p (inch$^{-1}$) | Continuous recording | Recoverableness | Ink mobility |
| 1 | 3.5 | 20 | 70 | X | X | X |
| 2 | 2.5 | 30 | 70 | X | X | X |
| 3 | 4.5 | 20 | 90 | X | X | X |
| 4 | 3.0 | 30 | 90 | X | X | X |
| 5 | 1.8 | 50 | 90 | X | X | X |
| 6 | 5.0 | 20 | 100 | ○ | Δ | ○ |
| 7 | 2.5 | 40 | 100 | ○ | Δ | ○ |
| 8 | 2.0 | 50 | 100 | ○ | Δ | ○ |
| 9 | 6.0 | 20 | 120 | ○ | ○ | ○ |
| 10 | 4.0 | 30 | 120 | ○ | ○ | ○ |
| 11 | 3.0 | 40 | 120 | ○ | ○ | ○ |
| 12 | 5.0 | 30 | 150 | ○ | ○ | ○ |
| 13 | 3.0 | 50 | 150 | ○ | ○ | ○ |
| 14 | 5.5 | 30 | 165 | ○ | Δ | ○ |
| 15 | 4.0 | 40 | 160 | ○ | Δ | ○ |
| 16 | 3.2 | 50 | 160 | ○ | Δ | ○ |
| 17 | 9.0 | 20 | 180 | ○ | Δ | ○ |
| 18 | 6.0 | 30 | 180 | ○ | Δ | ○ |
| 19 | 4.5 | 40 | 180 | ○ | Δ | ○ |
| 20 | 6.66 | 30 | 200 | ○ | Δ | ○ |
| 21 | 5.0 | 40 | 200 | ○ | Δ | ○ |
| 22 | 4.0 | 50 | 200 | ○ | Δ | ○ |
| 23 | 7.0 | 30 | 210 | X | Δ | X |
| 24 | 5.5 | 40 | 220 | X | X | X |
| 25 | 4.4 | 50 | 220 | X | X | X |
| 26 | 8.0 | 30 | 240 | X | X | X |
| 27 | 6.0 | 40 | 240 | X | X | X |
| 28 | 4.8 | 50 | 240 | X | X | X |

TABLE 5

| | | | | Printing test (stored at 60° C.) | | | | | |
|---|---|---|---|---|---|---|---|---|---|
| | | | | Initial | | | 1 month later | | |
| No. | Initial | After washing once | After washing twice | O.D. | Bleeding | Strike-through | O.D. | Bleeding | Strike-through |
| | Content of eluted matters*1 (wt %) | | | | | | | | |
| Example 1 | 0.25 | 0.07 | — | ○ | ○ | ○ | ○ | ○ | ○ |
| Example 2 | 0.25 | 0.1 | — | ○ | ○ | ○ | ○ | ○ | ○ |
| Example 3 | 0.25 | 0.09 | — | ○ | ○ | ○ | ○ | ○ | ○ |
| Example 4 | 0.65 | 0.15 | — | ○ | ○ | ○ | ○ | ○ | ○ |
| Example 5 | 0.25 | 0.12 | — | ○ | ○ | ○ | ○ | ○ | ○ |
| Example 6 | 0.65 | — | 0.03 | ○ | ○ | ○ | ○ | ○ | ○ |
| Example 7 | 0.65 | 0.19 | — | ○ | ○ | ○ | ○ | ○ | ○ |
| Example 8 | 0.65 | 0.20 | | ◎ | ◎ | ◎ | ◎ | ◎ | ◎ |
| Comparative Example 1 | 0.25 | — | — | ○ | ○ | ○ | ○ | Δ | ○ |
| Comparative Example 2 | 0.65 | — | — | Δ | Δ | Δ | Δ | X | Δ |
| | PEPO Content in ink (wt % absorber) | | | | | | | | |
| Reference Example NO. 1 | 0.10 | — | | ○ | ○ | ○ | | | |
| Reference Example NO. 2 | 0.15 | — | | ○ | ○ | ○ | | | |
| Reference | 0.2 | — | | ○ | ○ | ○ | | | |

TABLE 5-continued

| | | | | | | |
|---|---|---|---|---|---|---|
| Example NO. 3 | | | | | | |
| Reference Example NO. 4 | 0.25 | — | X | X | X | |
| Reference Example NO. 5 | 0.0 | — | ○ | ○ | ○ | |

| No. | Initial | After washing once | After washing twice | Printing test (stored at 60° C.) 2 month later O.D. | Bleeding | Strike-through | 3 month later O.D. | Bleeding | Strike-through |
|---|---|---|---|---|---|---|---|---|---|
| | Content of eluted matters*1 (wt %) | | | | | | | | |
| Example 1 | 0.25 | 0.07 | — | ○ | ○ | ○ | ○ | ○ | ○ |
| Example 2 | 0.25 | 0.1 | — | ○ | ○ | ○ | ○ | ○ | ○ |
| Example 3 | 0.25 | 0.09 | — | ○ | ○ | ○ | ○ | ○ | ○ |
| Example 4 | 0.65 | 0.15 | — | ○ | ○ | ○ | ○ | ○ | ○ |
| Example 5 | 0.25 | 0.12 | — | ○ | ○ | ○ | ○ | ○ | ○ |
| Example 6 | 0.65 | — | 0.03 | ○ | ○ | ○ | ○ | ○ | ○ |
| Example 7 | 0.65 | 0.19 | — | ○ | ○ | ○ | ○ | ○ | ○ |
| Example 8 | 0.65 | 0.20 | | ○ | ○ | ○ | ○ | Δ | ○ |
| Comparative Example 1 | 0.25 | — | — | Δ | Δ | Δ | X | X | X |
| Comparative Example 2 | 0.65 | — | — | X | X | X | X | X | X |

*1Content of eluted matters represents wt % to 1 g of an ink absorber

What is claimed is:

1. An ink tank having an ink storing portion encasing an ink-absorbent member for holding ink, the ink-absorbent member comprising a porous material having therein compressed open cells, the compression ratio $r_1$ of an apparent volume $V_1$ before compression to an apparent volume $V_2$ after compression ($r_1 = V_1/V_2$) and the cell number p represented by number of cells per inch in the state of $V_1$ satisfying the relation (I) below, and p being not more than 60:

$$100 \text{ inch } [\text{inch}^{-1}] \leqq r_1 \cdot p \leqq 200 \ [\text{inch}^{-1}] \quad \text{(I)}$$

2. The ink tank of claim 1, wherein the ink-absorbent member comprises a polyurethane.

3. The ink tank of claim 1, wherein the ink-absorbent member has an apparent density of not higher than 0.20 g/cm$^3$.

4. The ink tank of claim 1, wherein the cell number p is in the range of from 20 inch$^{-1}$ to 60 inch$^{-1}$.

5. The ink tank of claim 1, wherein the compression ratio $r_1$ and the cell number p satisfies Formula (II) below:

$$120 \ [\text{inch}-1] \leqq r_1 \cdot p \leqq 150 \ [\text{inch}-1] \quad \text{(II)}$$

6. The ink tank of claim 1, wherein ink is held in the ink-storing portion.

7. The ink tank of claim 1, wherein the ink comprises water, a water-soluble organic solvent, and a coloring matter.

8. The ink tank of claim 7, wherein the coloring matter is a water-soluble dye.

9. An ink-jet cartridge having an ink storing portion encasing an ink absorbent member for holding ink, the ink-absorbent member comprising a porous material having therein open cells, the volume ratio K of an apparent volume $V_5$ of the porous material in a dried and no-ink-containing state outside of the ink storing portion to an apparent volume $V_6$ of the porous material in an ink-impregnated state encased in the ink storing portion ($K = V_5/V_6$) and the cell number p represented by number of cells per inch in the state of $V_1$ satisfying the relation (I) below, and p being not more than 60:

$$100 \ [\text{inch}^{-1}] \leqq K \cdot p \leqq 200 \ [\text{inch}^{-1}] \quad \text{(III)}$$

10. The ink-jet cartridge of claim 9, wherein the ink-absorbent member comprises a polyurethane, 11. The ink-jet cartridge of claim 9, wherein the ink-absorbent member has an apparent density of not higher than 0.20 g/cm$^3$.

12. The ink-jet cartridge of claim 9, wherein the cell number p is in the range of from 20 inch$^{-1}$ to 60 inch$^{-1}$.

13. The ink-jet cartridge of claim 9, wherein the compression ratio $r_1$ and the cell number p satisfies Formula (II) below:

$$120 \ [\text{inch}^{-1}] \leqq K \cdot p \leqq 150 \ [\text{inch}^{-1}] \quad \text{(IV)}$$

14. The ink-jet cartridge of claim 9, wherein ink is held in the ink-storing portion.

15. The ink-jet cartridge of claim 14, wherein the ink comprises water, a water-soluble organic solvent, and a coloring matter.

16. The ink-jet cartridge of claim 15, wherein the coloring matter is a water-soluble dye.

17. An ink-jet cartridge having an ejection energy-generating means for ejecting ink and an ink storing portion encasing an ink-absorbent member for holding ink to be supplied to the ejection energy-generating means, the ink-absorbent member comprising a porous material having therein compressed open cells, the compression ratio $r_1$ of an apparent volume $V_1$ before compression to an apparent volume $V_2$ after compression ($r_1 = V_1/V_2$) and the cell number p represented by number of cells per inch in the state of $V_1$ satisfying the relation (I) below, and p being not more than 60:

$$100 \ [\text{inch}^{-1}] \leqq r_1 \cdot p \leqq 200 \ [\text{inch}^{-1}] \quad \text{(I)}$$

18. The ink-jet cartridge of claim 17, wherein the ink-absorbent member comprises a polyurethane.

19. The ink-jet cartridge of claim 17, wherein the ink-absorbent member has an apparent density of not higher than 0.20 g/cm$^3$.

20. The ink-jet cartridge of claim 17, wherein the cell number p is in the range of from 20 inch$^{-1}$ to 60 inch$^{-1}$.

21. The ink-jet cartridge of claim 17, wherein the compression ratio $r_1$ and the cell number p satisfies Formula (II) below:

$$120\ [\text{inch}^{-1}] \leqq r_1 \cdot p \leqq 150\ [\text{inch}^{-1}] \quad \text{(II)}$$

22. The ink-jet cartridge of claim 17, wherein ink is held in the ink-storing portion.

23. The ink-jet cartridge of claim 22, wherein the ink comprises water, a water-soluble organic solvent, and a coloring matter.

24. The ink-jet cartridge of claim 23, wherein the coloring matter is a water-soluble dye.

25. The ink-jet cartridge of claim 17, wherein the ejection energy-generating means is a heat energy generating means for causing film boiling in the ink in response to an electric signal.

26. An ink-jet cartridge having an ejection energy-generating means for ejecting ink and an ink storing portion encasing an ink-absorbent member for holding ink to be supplied to the ejection energy-generating means, the ink-absorbent member comprising a porous material having therein open cells, the volume ratio K of an apparent volume $V_5$ of the porous material in a dried and no-ink-containing state outside the ink storing portion to an apparent volume $V_6$ of the porous material in an ink-impregnated state encased in the ink storing portion ($K = V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \quad \text{(III)}$$

27. The ink-jet cartridge of claim 26, wherein the ink-absorbent member comprises a polyurethane.

28. The ink-jet cartridge of claim 26, wherein the ink-absorbent member has an apparent density of not higher than 0.20 g/cm$^3$.

29. The ink-jet cartridge of claim 26, wherein the cell number p is in the range of from 20 inch$^{-1}$ to 60 inch$^{-1}$.

30. The ink-jet cartridge of claim 26, wherein the compression ratio $r_1$ and the cell number p satisfies Formula (II) below:

$$120\ [\text{inch}^{-1}] \leqq K \cdot p \leqq 150\ [\text{inch}^{-1}] \quad \text{(IV)}$$

31. The ink-jet cartridge of claim 26, wherein ink is held in the ink-storing portion.

32. The ink-jet cartridge of claim 31; wherein the ink comprises water, a water-soluble organic solvent, and a coloring matter.

33. The ink-jet cartridge of claim 32, wherein the coloring matter is a water-soluble dye.

34. The ink-jet cartridge of claim 26, wherein the ejection energy-generating means is a heat energy generating means for causing film boiling in the ink in response to an electric signal.

35. An ink-jet cartridge provided with an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, a supply tube for supplying ink pressed into an ink-absorbent member in the ink-storing portion, and a filter at an end of the supply tube; the ink-absorbent member comprising a porous material having therein compressed open cells, the compression ratio $r_1$ of an apparent volume $V_1$ before compression to an apparent volume $V_2$ after compression ($r_1 = V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

36. The ink-jet cartridge of claim 35, wherein the ink-absorbent member comprises a polyurethane.

37. The ink-jet cartridge of claim 35, wherein the ink-absorbent member has an apparent density of not higher than 0.20 g/cm$^3$.

38. The ink-jet cartridge of claim 35, wherein the cell number p is in the range of from 20 inch$^{-1}$ to 60 inch$^{-1}$.

39. The ink-jet cartridge of claim 35, wherein the compression ratio $r_1$ and the cell number p satisfies Formula (II) below:

$$120\ [\text{inch}^{-1}] \leqq r_1 \cdot p \leqq 150\ [\text{inch}^{-1}] \quad \text{(II)}$$

40. The ink-jet cartridge of claim 35, wherein ink is held in the ink-storing portion.

41. The ink-jet cartridge of claim 40, wherein the ink comprises water, a water-soluble organic solvent, and a coloring matter.

42. The ink-jet cartridge of claim 41, wherein the coloring matter is a water-soluble dye.

43. The ink-jet cartridge of claim 35, wherein the ejection energy-generating means is a heat energy generating means for causing film boiling in the ink in response to an electric signal.

44. The ink-jet cartridge provided with an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, and a supply tube for supplying ink pressed into an ink-absorbent member in the ink-storing portion, and a filter at an end of the supply tube; the ink-absorbent member comprising a porous material having therein open cells, the volume ratio K of an apparent volume $V_5$ of the porous material in a dried and no-ink-containing state outside the ink storing portion to an apparent volume $V_6$ of the ink storing portion ($K = V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \quad \text{(III)}$$

45. The ink-jet cartridge of claim 44, wherein the ink-absorbent member comprises a polyurethane.

46. The ink-jet cartridge of claim 44, wherein the ink-absorbent member has an apparent density of not higher than 0.20 g/cm$^3$.

47. The ink-jet cartridge of claim 44, wherein the cell number p is in the range of from 20 inch$^{-1}$ to 60 inch$^{-1}$.

48. The ink-jet cartridge of claim 44, wherein the compression ratio $r_1$ and the cell number p satisfies Formula (II) below:

$$120\ [\text{inch}^{-1}] \leqq K \cdot p \leqq 150\ [\text{inch}^{-1}] \quad \text{(IV)}$$

49. The ink-jet cartridge of claim 44, wherein ink is held in the ink-storing portion.

50. The ink-jet cartridge of claim 49, wherein the ink comprises water, a water-soluble organic solvent, and a coloring matter.

51. The ink-jet cartridge of claim 50, wherein the coloring matter is a water-soluble dye.

52. The ink-jet cartridge of claim 44, wherein the ejection energy-generating means is a heat energy generating means for causing film boiling in the ink in response to an electric signal.

53. An ink-jet recording apparatus provided with an ink cartridge having an ejection energy-generating means for ejecting ink and an ink storing portion encasing an ink-absorbent member for holding ink to be supplied to the ejection energy-generating means, a carriage for moving the ink-jet cartridge to a desired direction, and an electric signal supplying means for supplying an electric signal to the ejection energy-generating means; the ink-absorbent member comprising a porous material having therein compressed open cells, the compression ratio $r_1$ of an apparent volume $V_1$ before compression to an apparent volume $V_2$ after compression ($r_1 = V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

54. The ink-jet recording apparatus of claim 53, wherein the ink-absorbent member comprises a polyurethane.

55. The ink-jet recording apparatus of claim 53, wherein the ink-absorbent member has an apparent density of not higher than 0.20 g/cm$^3$.

56. The ink-jet recording apparatus of claim 53, wherein the cell number p is in the range of from 20 inch$^{-1}$ to 60 inch$^{-1}$.

57. The ink-jet recording apparatus of claim 53, wherein the compression ratio $r_1$ and the cell number p satisfies Formula (II) below:

$$120\ [\text{inch}^{-1}] \leqq r_1 \cdot p \leqq 150\ [\text{inch}^{-1}] \quad \text{(II)}$$

58. The ink-jet recording apparatus of claim 53, wherein ink is held in the ink-storing portion.

59. The ink-jet recording apparatus of claim 58, wherein the ink comprises water, a water-soluble organic solvent, and a coloring matter.

60. The ink-jet recording apparatus of claim 59, wherein the coloring matter is a water-soluble dye.

61. The ink-jet recording apparatus of claim 53, wherein the ejection energy-generating means is a heat energy generating means for causing film boiling in the ink in response to an electric signal.

62. An ink-jet recording apparatus provided with an ink cartridge having an ejection energy-generating means for ejecting ink and an ink storing portion encasing an ink-absorbent member for holding ink to be supplied to the ejection energy-generating means, a carriage for moving the ink-jet cartridge to a desired direction, and an electric signal supplying means for supplying an electric signal to the ejection energy-generating means; the ink-absorbent member comprising a porous material having therein open cells, the volume ratio K of an apparent volume $V_5$ of the porous material in a dried and no-ink-containing state outside the ink storing portion to an apparent volume $V_6$ of the porous material in an ink-impregnated state encased in the ink storing portion ($K = V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \quad \text{(III)}$$

63. The ink-jet recording apparatus of claim 62, wherein the ink-absorbent member comprises a polyurethane.

64. The ink-jet recording apparatus of claim 62, wherein the ink-absorbent member has an apparent density of not higher than 0.20 g/cm$^3$.

65. The ink-jet recording apparatus of claim 62, wherein the cell number p is in the range of from 20 inch$^{-1}$ to 60 inch$^{-1}$.

66. The ink-jet recording apparatus of claim 62, wherein the compression ratio $r_1$ and the cell number p satisfies Formula (II) below:

$$120\ [\text{inch}^{-1}] \leqq K \cdot p \leqq 150\ [\text{inch}^{-1}] \quad \text{(IV)}$$

67. The ink-jet recording apparatus of claim 62, wherein ink is held in the ink-storing portion.

68. The ink-jet recording apparatus of claim 67, wherein the ink comprises water, a water-soluble organic solvent, and a coloring matter.

69. The ink-jet recording apparatus of claim 68, wherein the coloring matter is a water-soluble dye.

70. The ink-jet recording apparatus of claim 62, wherein the ejection energy-generating means is a heat energy generating means for causing film boiling in the ink in response to an electric signal.

71. The ink-jet recording apparatus provided with an ink cartridge having an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, a supply tube for supplying ink pressed into an ink-absorbent member in the ink-storing portion, and a filter at an end of the supply tube; the ink-absorbent member comprising a porous material having therein compressed open cells, the compression ratio $r_1$ of an apparent volume $V_1$ before compression to an apparent volume $V_2$ after compression ($r_1 = V_1/V_2$) and the cell number p represented by number of cells per inch in the state of $V_1$ satisfying the relation (I) below, and p being not more than 60:

$$100\ [\text{inch}^{-1}] \leqq r_1 \cdot p \leqq 200\ [\text{inch}^{-1}] \quad \text{(I)}$$

72. The ink-jet recording apparatus of claim 71, wherein the ink-absorbent member comprises a polyurethane.

73. The ink-jet recording apparatus of claim 71, wherein the ink-absorbent member has an apparent density of not higher than 0.20 g/cm$^3$.

74. The ink-jet recording apparatus of claim 71, wherein the cell number p is in the range of from 20 inch$^{-1}$ to 60 inch$^{-1}$.

75. The ink-jet recording apparatus of claim 71, wherein the compression ratio $r_1$ and the cell number p satisfies Formula (II) below:

$$120\ [\text{inch}^{-1}] \leqq r_1 \cdot p \leqq 150\ [\text{inch}^{-1}] \quad \text{(II)}$$

76. The ink-jet recording apparatus of claim 71, wherein ink is held in the ink-storing portion.

77. The ink-jet recording apparatus of claim 76, wherein the ink comprises water, a water-soluble organic solvent, and a coloring matter.

78. The ink-jet recording apparatus of claim 77, wherein the coloring matter is a water-soluble dye.

79. The ink-jet recording apparatus of claim 71, wherein the ejection energy-generating means is a heat energy generating means for causing film boiling in the ink in response to an electric signal.

80. The ink-jet recording apparatus provided with an ink cartridge having an ink-storing portion having separately an air-communicating opening and an ink-discharging portion for supplying ink outside and encasing an ink-absorbent member therein, an ejection energy-generating means for ejecting ink, an ink chamber for holding ink to be supplied to the ejection energy-generating means, and a supply tube for supplying ink pressed into an ink-absorbent member in the ink-storing portion; the ink-absorbent member comprising a porous material, the volume ratio K of an apparent volume $V_5$ of the porous material in a dried and no-ink-containing state outside the ink storing portion to the volume $V_6$ of the ink storing portion ($K=V_5/V_6$) and the cell number p represented by number of cells per inch in the state of $V_1$ satisfying the relation (I) below, and p being not more than 60:

$$100\ [\text{inch}^{-1}] \leqq K \cdot p \leqq 200\ [\text{inch}^{-1}] \quad \text{(III)}$$

81. The ink-jet recording apparatus of claim 80, wherein the ink-absorbent member comprises a polyurethane.

82. The ink-jet recording apparatus of claim 80, wherein the ink-absorbent member has an apparent density of not higher than 0.20 g/cm$^3$.

83. The ink-jet recording apparatus of claim 80, wherein the cell number p is in the range of from 20 inch$^{-1}$ to 60 inch$^{-1}$.

84. The ink-jet recording apparatus of claim 80, wherein the compression ratio $r_1$ and the cell number p satisfies Formula (II) below:

$$120\ [\text{inch}^{-1}] \leqq K \cdot p \leqq 150\ [\text{inch}^{-1}] \quad \text{(IV)}$$

85. The ink-jet recording apparatus of claim 80, wherein ink is held in the ink-storing portion.

86. The ink-jet recording apparatus of claim 85, wherein the ink comprises water, a water-soluble organic solvent, and a coloring matter.

87. The ink-jet recording apparatus of claim 86, wherein the coloring matter is a water-soluble dye.

88. The ink-jet recording apparatus of claim 86, wherein the ejection energy-generating means is a heat energy generating means for causing film boiling in the ink in response to an electric signal.

* * * * *

UNITED STATES PATENT AND TRADEMARK OFFICE

CERTIFICATE OF CORRECTION

PATENT NO. : 5,182,579
DATED : January 26, 1993
INVENTOR(S) : Haruta et al.

It is certified that error appears in the above-indentified patent and that said Letters Patent is hereby corrected as shown below:

SHEET 11 OF THE DRAWINGS:

In Fig. 14, "SATISFYIG" should read --SATISFYING--.

COLUMN 2:

Line 12, "arises" should read --arise--.

COLUMN 4:

Line 17, "cell" should read --cells--.

COLUMN 5:

Line 55, "amoung" should read --amount--.

COLUMN 13:

Line 29, "tions" should read --tion--; and
Line 39, "relatin" should read --relation--.

COLUMN 14:

Line 1, "in an oven" should be deleted.

UNITED STATES PATENT AND TRADEMARK OFFICE

CERTIFICATE OF CORRECTION

PATENT NO. : 5,182,579

DATED : January 26, 1993

INVENTOR(S) : Haruta et al.

It is certified that error appears in the above-indentified patent and that said Letters Patent is hereby corrected as shown below:

COLUMN 15:

Line 54, "portions," should read --portion,--; and
Line 55, "planes" should read --plane--.

COLUMN 19:

Line 17, "FIG.," should read --FIG. 13,--.

COLUMN 20:

Line 8, "prior those," should read --those prior,--;
Line 16, "was been" should read --has been--;
Line 21, "are suitable those" should read --suitable are those--; and
Line 50, "member. The" should read --member. ¶ The--.

COLUMN 21:

Line 1, "on" should be deleted.

COLUMN 23:

Line 36, "eluted" should read --for eluting--;
Line 37, "prescribed that or less" should read --such as that prescribed or less--; and
Line 60, "a few" should be deleted.

UNITED STATES PATENT AND TRADEMARK OFFICE

CERTIFICATE OF CORRECTION

PATENT NO. : 5,182,579 Page 3 of 3

DATED : January 26, 1993

INVENTOR(S) : Haruta et al.

It is certified that error appears in the above-indentified patent and that said Letters Patent is hereby corrected as shown below:

COLUMN 28:

Line 57, "toluenes" should read --toluene--.

COLUMN 32:

Line 16, "an" should read --a--; and
Line 30, "amount" should read --amount was--.

COLUMN 39:

Line 51, "120 [inch-1] $\leq r_1.p \leq$ 150 [inch-1]" should read --120 [$inch^{-1}$] $\leq r_1.p \leq$ 150 [$inch^{-1}$]--.

Signed and Sealed this

First Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,182,579

DATED : January 26, 1993

INVENTOR(S) : Masahiro HARUTA, ET AL.

It is certified that error appears in the above-indentified patent and that said Letters Patent is hereby corrected as shown below:

COLUMN 40:

Line 29, "$V_1$" should read --$V_5$--;

Line 30, "(I)" should read --(III)--; and

Line 41, "$r_1$" should read --K--.

COLUMN 41:

Line 33, "$V_1$" should read --$V_5$--;

Line 34, "(I)" should read --(III)--;

Line 46, "$r_1$" should read --K--; and

Line 47, "(II)" should read --(IV)--.

COLUMN 42:

Line 52, "$V_1$" should read --$V_5$--;

Line 53, "(I)" should read --(III)--;

Line 66, "$r_1$" should read --K--; and

Line 67, "(II)" should read --(IV)--.

UNITED STATES PATENT AND TRADEMARK OFFICE

CERTIFICATE OF CORRECTION

PATENT NO. : 5,182,579

DATED : January 26, 1993

INVENTOR(S) : Masahiro HARUTA, ET AL.

It is certified that error appears in the above-indentified patent and that said Letters Patent is hereby corrected as shown below:

COLUMN 44:

Line 4, "$V_1$" should read --$V_5$--;

Line 5, "(I)" should read --(III)--;

Line 19, "$r_1$" should read --K--; and

Line 20, "(II)" should read --(IV)--.

COLUMN 45:

Line 28, "$V_1$" should read --$V_5$--; and

"(I)" should read --(III)--.

COLUMN 46:

Line 14, "$r_1$" should read --K--; and

Line 15, "(II)" should read --(IV)--.

Signed and Sealed this

Eleventh Day of October, 1994

*Attest:*

Bruce Lehman

BRUCE LEHMAN

*Attesting Officer*

*Commissioner of Patents and Trademarks*